US011718493B2

(12) United States Patent
Iwata et al.

(10) Patent No.: US 11,718,493 B2
(45) Date of Patent: Aug. 8, 2023

(54) RECORDING APPARATUS

(71) Applicant: SEIKO EPSON CORPORATION, Tokyo (JP)

(72) Inventors: Morio Iwata, Matsumoto (JP); Satoshi Yoshino, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 2 days.

(21) Appl. No.: 17/209,683

(22) Filed: Mar. 23, 2021

(65) Prior Publication Data

US 2021/0300711 A1 Sep. 30, 2021

(30) Foreign Application Priority Data

Mar. 26, 2020 (JP) ..... 2020-055623

(51) Int. Cl.
*B65H 31/20* (2006.01)
*B41J 11/58* (2006.01)

(52) U.S. Cl.
CPC ..... *B65H 31/20* (2013.01); *B41J 11/58* (2013.01)

(58) Field of Classification Search
CPC ..... B65H 31/20; B65H 31/00; B65H 31/02; B65H 31/08; B65H 31/10; B65H 2405/10; B65H 2405/1144; B65H 2405/15; B65H 2405/324; B65H 2405/321; B65H 2405/11164; B65H 2405/11151; B65H 2405/1164; B65H 2405/115; B65H 2405/32; B41J 11/58
See application file for complete search history.

(56) References Cited

U.S. PATENT DOCUMENTS 6,729,616 B2 * 5/2004 Chen ..... B65H 31/22 271/213
2013/0032989 A1 * 2/2013 Okuchi ..... B65H 1/04 271/9.01
2018/0029393 A1 2/2018 Matsumoto
2018/0272763 A1 9/2018 Yoshino et al.
2020/0131394 A1 4/2020 Fujii et al.
2022/0289996 A1 9/2022 Fujii et al.

FOREIGN PATENT DOCUMENTS

JP 6218897 B1 10/2017
JP 2018158835 A 10/2018
WO 2019004485 A1 1/2019

OTHER PUBLICATIONS

Office Action for CN Patent Application No. CN202110322327.0, dated Sep. 29, 2022, 11 pages of Office Action.

* cited by examiner

*Primary Examiner* — Thomas A Morrison
(74) *Attorney, Agent, or Firm* — Chip Law Group

(57) ABSTRACT

A medium receiving tray has a first tray and a second tray. A movable support having a second support surface for supporting media is disposed in the second tray. When the medium receiving tray is in a first state, the movable support is positioned above a first support surface of the first tray. When the medium receiving tray is switched from the first state to a second state, a free end is detached from the downstream end of the first support surface and displaced downward, and the second support surface is thereby inclined upward toward the downstream in a medium discharging direction.

8 Claims, 30 Drawing Sheets

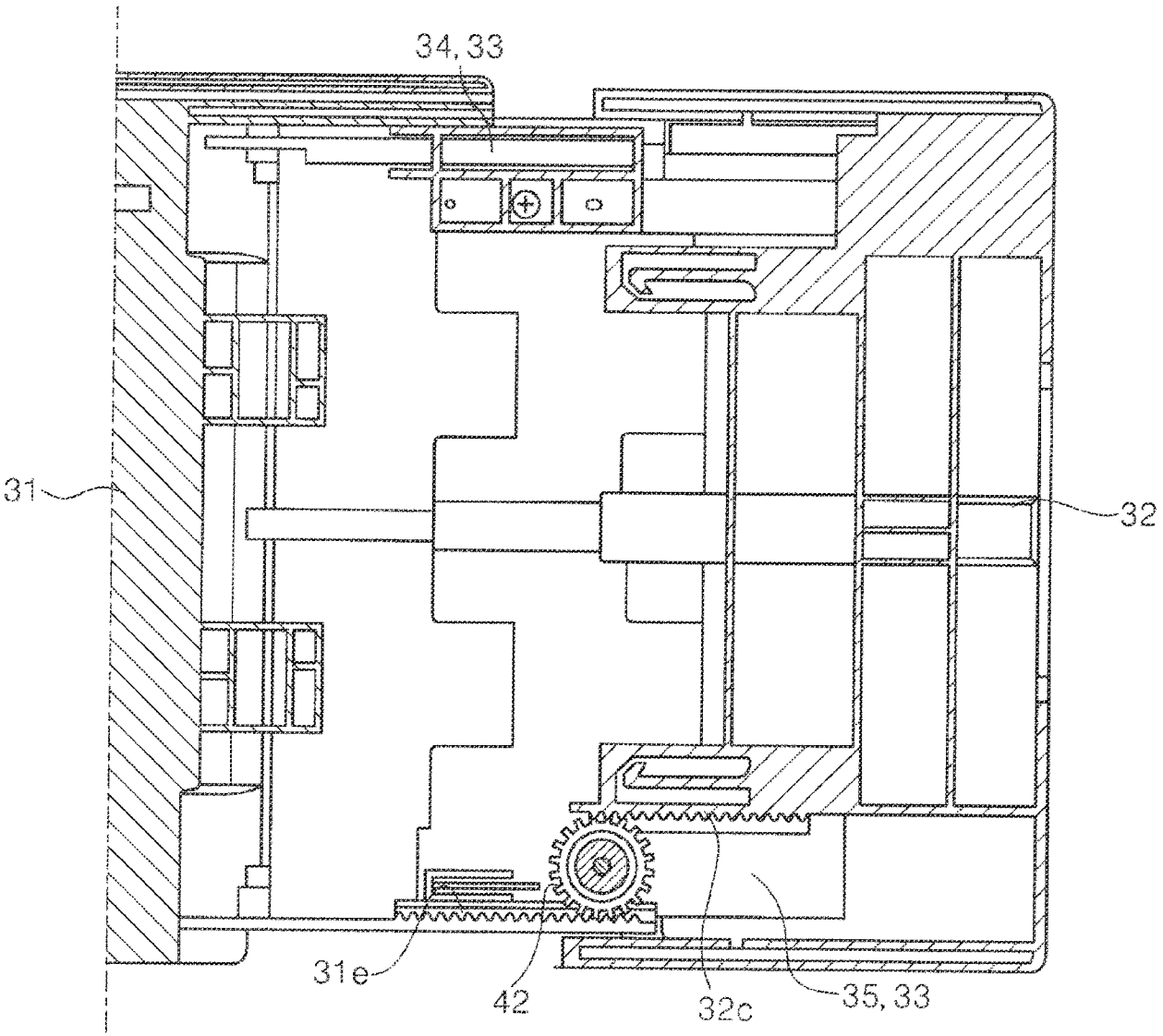
FIG. 15
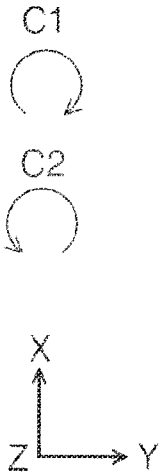

RECORDING APPARATUS

The present application is based on, and claims priority from JP Application Serial Number 2020-055623, filed Mar. 26, 2020, the disclosure of which is hereby incorporated by reference herein in its entirety.

BACKGROUND

1. Technical Field

The present disclosure relates to a recording apparatus that performs recording onto media.

2. Related Art

A recording apparatus, such as a facsimile machine or a printer as a representative example, may have a medium receiving tray to receive media discharged after recording. A type of medium receiving tray is formed of multiple trays and is switchable between a stored state and an unfolded state. A medium receiving tray disclosed in JP-A-2018-158835 is formed of a first tray and a second tray. The second tray is positioned downstream from the first tray in the medium discharging direction when the medium receiving tray is in an unfolded state. In other words, the second tray protrudes further outward than the first tray.

A technical problem associated with a known medium receiving tray will be described with reference to FIG. 30. Reference sign 101 denotes a first tray positioned at the base end of the medium receiving tray, and reference sign 102 denotes a second tray positioned at the free end thereof. The first tray and the second tray are in an unfolded state. A support surface 102*a* of the second tray 102 normally disposed at a position below a support surface 101*a* of the first tray 101. Accordingly, when a medium P is discharged, the medium P proceeds smoothly over the medium receiving tray without the leading edge of the medium P getting caught.

In the case of the medium receiving tray being formed this way, the medium P proceeds downward in the discharging direction Ya as illustrated. As a result, the discharged medium P tends to slip off the medium receiving tray.

To address this problem, it may be necessary to provide a stopper at the end of the second tray 102, and the stopper is configured to be switched between a stored state and a protruding state. In a case of letting a user handle the switching of the stopper, however, the user may forget to do so or user's operation may become complicated. Using a motor to operate the stopper disposed at the end of the tray requires a complicated system.

SUMMARY

According to an aspect of the present disclosure, a recording apparatus includes an apparatus body having a recording device to perform recording onto a medium and also includes a medium receiving tray. The medium receiving tray is configured to be switched between a first state in which the medium receiving tray is stored in the apparatus body and a second state in which the medium receiving tray is protruded furthest from the apparatus body. The medium receiving tray is also configured to receive the medium discharged from the apparatus body in the second state or in a state in which the medium receiving tray is protruded from the first state to the second state. The medium receiving tray includes a first tray and a second tray. The first tray is displaceable relative to the apparatus body, and the second tray is displaceable relative to the first tray. The second tray is protruded further than the first tray from the apparatus body when the medium receiving tray is in the second state. The first tray has a first support surface that supports the medium when the medium receiving tray is in the second state. The second tray has a movable support that is rotatable with an upstream end thereof serving as a free end and that has a second support surface for supporting the medium, and the movable support is positioned above the first support surface when the medium receiving tray is in the first state. When the medium receiving tray is switched from the first state to the second state, a free end is detached from a downstream end of the first support surface and displaced downward, and the second support surface is thereby inclined upward toward a downstream in a medium discharging direction.

BRIEF DESCRIPTION OF THE DRAWINGS

FIG. 15 is another cross section of the medium receiving tray that is cut along an X-Y plane.

DESCRIPTION OF EXEMPLARY EMBODIMENTS

Figure 1:
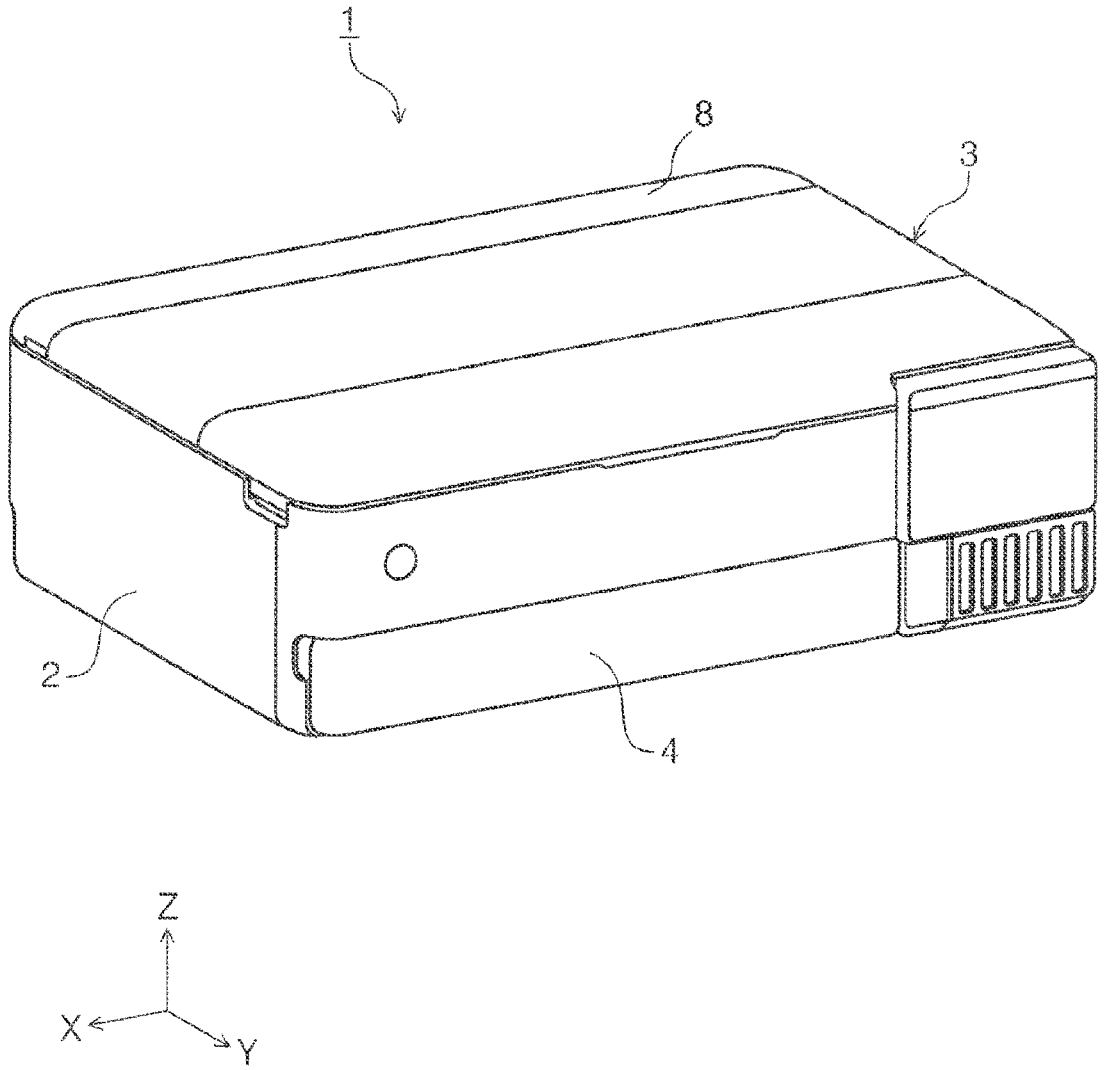
FIG. 1 is a perspective view illustrating a printer in which a medium receiving tray is in a stored state.

The present disclosure will be outlined first.

According to a first aspect of the disclosure, a recording apparatus includes an apparatus body having a recording device to perform recording onto a medium and also includes a medium receiving tray configured to be switched between a first state in which the medium receiving tray is stored in the apparatus body and a second state in which the medium receiving tray is protruded furthest from the apparatus body and also configured to receive the medium discharged from the apparatus body in the second state or in a state in which the medium receiving tray is protruded from the first state to the second state. The medium receiving tray includes a first tray and a second tray. The first tray is displaceable relative to the apparatus body, and the second tray is displaceable relative to the first tray. The second tray is protruded further than the first tray from the apparatus body when the medium receiving tray is in the second state. The first tray has a first support surface that supports the medium when the medium receiving tray is in the second state. The second tray has a movable support that is rotatable with an upstream end thereof serving as a free end and that has a second support surface for supporting the medium, and the movable support is positioned above the first support surface when the medium receiving tray is in the first state. When the medium receiving tray is switched from the first state to the second state, the free end is detached from a downstream end of the first support surface and displaced downward, and the second support surface is thereby inclined upward toward a downstream in a medium discharging direction.

According to this configuration, the medium receiving tray having the first tray and the second tray includes the movable support formed at the second tray. The movable support is rotatable while the upstream end thereof in the medium discharging direction serves as the free end. The movable support has the second support surface to support the medium. The movable support is positioned above the first support surface when the medium receiving tray is in the first state. When the medium receiving tray is switched from the first state to the second state, the free end is detached from the downstream end of the first support surface and displaced downward, and the second support surface is thereby inclined upward toward a downstream in a medium discharging direction. Accordingly, the medium proceeds over the medium receiving tray with the leading end being oriented upward, which reduces the likelihood of the medium falling off the medium receiving tray. The rotation or positional change of the movable support accompanies the state switching of the medium receiving tray irrespective of whether a user forgets to do so. Moreover, the positional change of the movable support can be implemented with a simple structure.

According to a second aspect of the present disclosure, in the recording apparatus according to the first aspect, a guide surface is formed at the downstream end of the first support surface in the medium discharging direction so as to guide the free end of the movable support onto the first support surface when the medium receiving tray returns from second state to the first state.

With this configuration, the likelihood of the free end of the movable support getting caught by the first tray can be reduced when the medium receiving tray returns from the second state to the first state.

According to a third aspect of the present disclosure, in the recording apparatus according to the first or the second aspect, the movable support has a guide rib formed at the free end so as to protrude upstream in the medium discharging direction, and the guide rib has an inclined surface that is inclined upward toward the downstream in the medium discharging direction. A groove is formed in the first tray so as to extend in the medium discharging direction and so as to engage the guide rib. When the medium receiving tray is in a transition state between the first state and the second state, the inclined surface of the guide rib is positioned so as to extend from a position below the first support surface to a position above the first support surface.

When the medium receiving tray is in a transition state between the first state and the second state, the leading end of the medium tends to be caught by the free end of the movable support because the free end is positioned above the first support surface. According to this configuration, however, the inclined surface is formed in the guide rib, which reduces the likelihood of the leading end of the medium getting caught by the free end.

According to a fourth aspect of the present disclosure, the recording apparatus according to any one of the first to third aspects further includes a motor that provides power for switching the state of the medium receiving tray, a pinion gear that engages a first rack that is formed in the first tray so as to extend in a displacement direction of the second tray and also engages a second rack that is formed in the second tray so as to extend in the displacement direction, and a displacing unit that rotatably supports the pinion gear and is displaced in the displacement direction by the power of the motor.

According to this configuration, the pinion gear is disposed between the first tray and the second tray. The displacing unit that supports the pinion gear is displaced in the displacement direction of the second tray, which thereby rotates the pinion gear. The rotation of the pinion gear displaces the second tray. With this configuration, the amount of displacement of the second tray can be increased relative to the amount of displacement of the displacing unit.

This can reduce the time required for the medium receiving tray to be switched from the first state to the second state, and vice versa.

According to a fifth aspect of the present disclosure, the recording apparatus according to the fourth aspect further includes a third rack that is formed in the displacing unit so as to extend in the displacement direction of the first tray and the second tray, a second pinion gear that engages the third rack, and a clutch that is disposed in a power transmission path from the motor to the second pinion gear and that transmits the power of the motor using friction. In the recording apparatus, both of the first tray and the second tray are displaced by rotation of the second pinion gear.

With this configuration, a single second pinion gear is able to move both of the first tray and the second tray, which leads to cost reduction of the apparatus.

The clutch is disposed in the power transmission path from the motor to the second pinion gear and transmits the power of the motor using friction. The clutch enables the motor to rotate idly relative to the second pinion gear even after the state switching of the medium receiving tray is completed, which prevents the rack-pinion mechanism from breaking.

When the medium receiving tray is moved manually, the clutch provides frictional resistance. With this configuration, the single second pinion gear moves both the first tray and the second tray, and only one clutch is necessary, which enables a user to manually move the medium receiving tray with less effort.

According to a sixth aspect of the present disclosure, the recording apparatus according to the fifth aspect further includes a frame that displaceably supports the first tray. When the state of the medium receiving tray is switched, friction generated between the displacing unit and the first tray is greater than friction generated between the first tray and the frame.

When the state of the medium receiving tray is switched, especially when switched from the first state to the second state, it is preferable to protrude the first tray before the protrusion of the second tray. The first tray is structurally more resistant to bending than the second tray. Accordingly, it is more preferable to receive media in the state in which the first tray is protruded compared with the state in which the second tray is only protruded.

According to this configuration, when the state of the medium receiving tray is switched, the friction generated between the displacing unit and the first tray is greater than the friction generated between the first tray and the frame. As a result, when the motor displaces the displacing unit, the first tray can be displaced together with the displacing unit. In other words, the first tray can be displaced prior to the displacement of the second tray. This eliminates the necessity to provide an additional drive mechanism to displace the first tray separately, which leads to cost reduction of the apparatus.

According to a seventh aspect of the present disclosure, the recording apparatus according to the sixth aspect further includes a friction member that generates friction between the displacing unit and the first tray and also includes a pressing member that presses the friction member against the first tray.

With this configuration, an appropriate friction can be reliably generated between the displacing unit and the first tray.

Now, the present disclosure is described more specifically.

Note that a direction parallel to the X-axis in the drawings (hereinafter referred to as the ""X-axis direction") is the width direction of the apparatus, which is a direction intersecting a sheet transporting direction, in other words, the sheet width direction. When the front side of the apparatus is viewed, a direction oriented toward the right side of the apparatus is referred to as the "−X direction", and a direction oriented toward the left side of the apparatus is referred to as the ""+X direction".

A direction parallel to the Y-axis (hereinafter referred to as the "Y-axis direction") is the front-rear direction of the apparatus. A direction from the rear side to the front side of the apparatus is referred to as the "+Y direction", and a direction from the front side to the rear side is referred to as the "−Y direction". The Y-axis direction is a direction in which a first tray 31 and a second tray 32 move. A medium receiving tray 30 is unfolded, in other words, extended in the +Y direction, which is the direction in which recorded sheets are discharged. The medium receiving tray 30 is folded and stored, in other words, retracted in the −Y direction.

The Z-axis direction is the vertical direction. The +Z direction is oriented upward, and the −Z direction is oriented downward.

In the present embodiment, the apparatus has sides, and a side at which a front cover 4 is disposed is the front side of the apparatus.

In FIG. 1, an ink jet printer 1, which is an example of a recording apparatus, is what is called a multifunction printer that includes a scanner unit 3 disposed in an upper part of the apparatus body 2. The ink jet printer 1 is hereinafter referred to simply as the "printer 1".

The apparatus body 2 has a sheet transport path (to be described later) along which recording sheets (an example of media) are transported. The apparatus body 2 also has a recording head 15 (see FIG. 4), which is an example of a recording device. In the present embodiment, the apparatus body 2 has two paper feed trays, or more specifically, a lower paper feed tray 5 and an upper paper feed tray 6 as specifically illustrated in FIG. 4. The upper paper feed tray 6 is moved in the Y-axis direction by a motor (not illustrated). The lower paper feed tray 5 is detachably mounted in the apparatus body 2.

The apparatus body 2 is configured such that sheets can be fed from the rear side of the apparatus as well as from the lower paper feed tray 5 and the upper paper feed tray 6. Reference sign 8 denotes a cover that covers a sheet setting opening (not illustrated) for feeding sheets from the rear side of the apparatus.

A front cover 4 is disposed at a lower front part of the apparatus body 2. The front cover 4 is disposed so as to be turnable to expose the lower paper feed tray 5. The front cover 4 is turned to assume a closed state illustrated in FIG. 1 or an open state illustrated in FIGS. 2 and 3.

Figure 2:
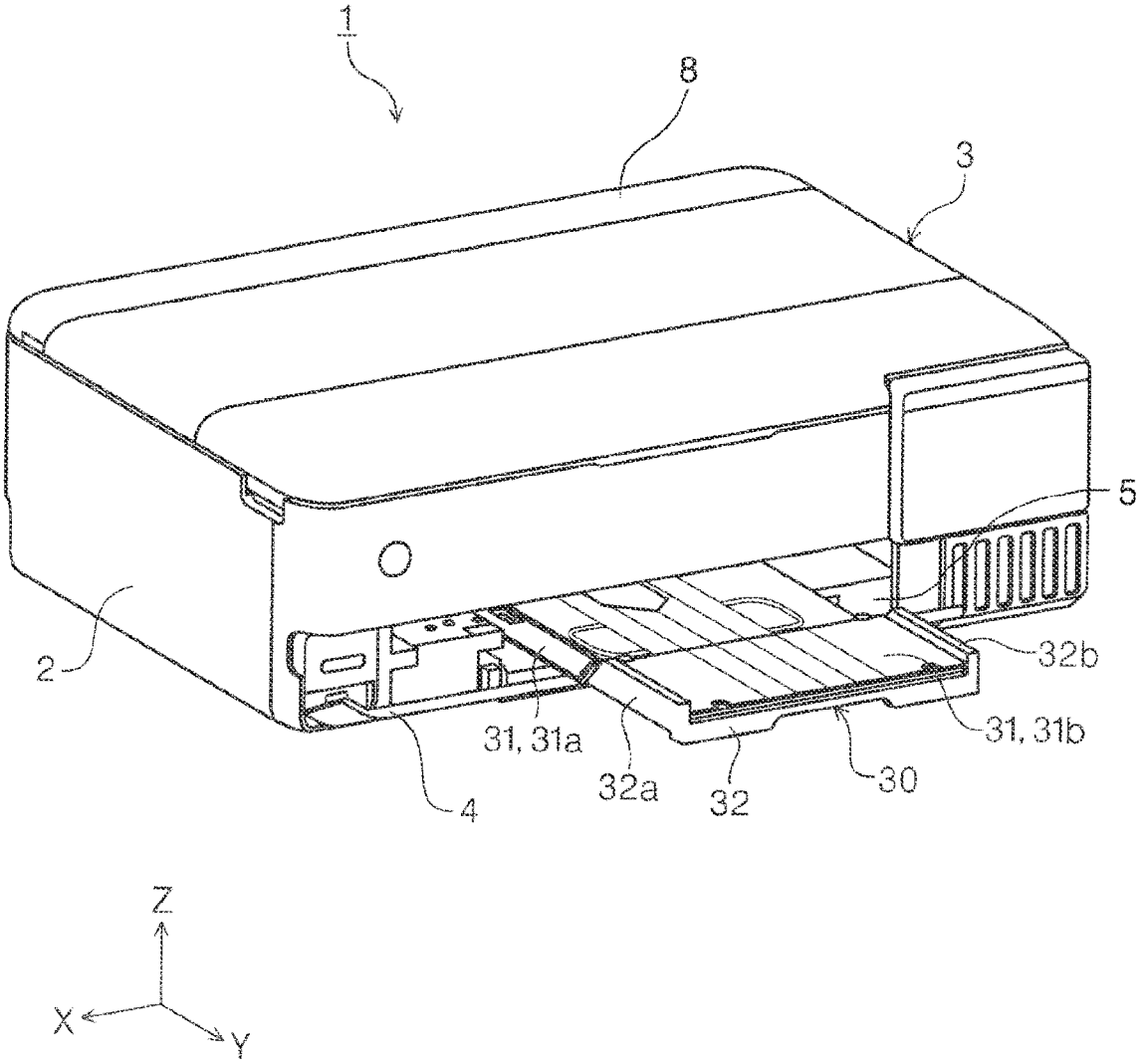
FIG. 2 is a perspective view illustrating the printer in which the medium receiving tray is in a first unfolded state.
Figure 3:
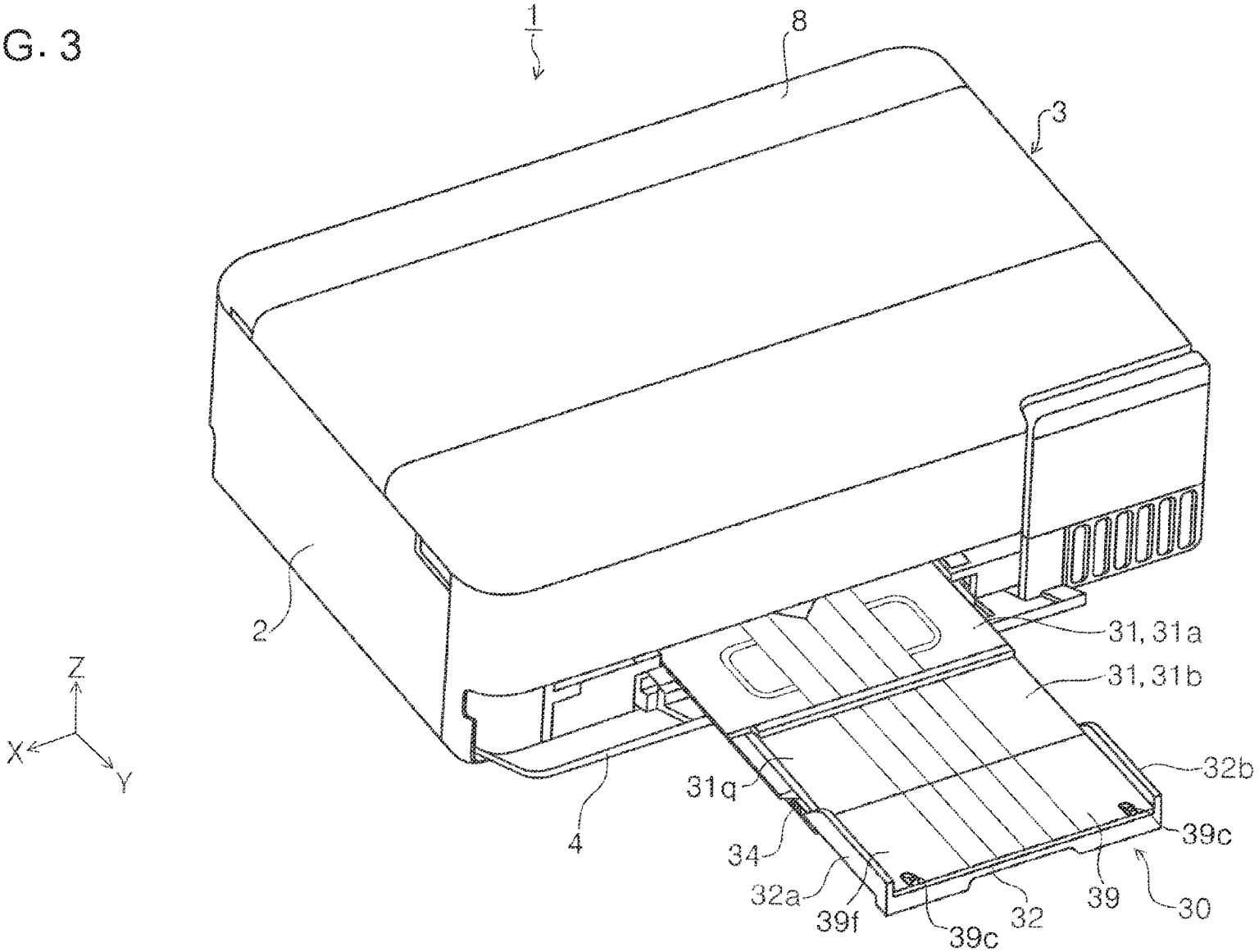
FIG. 3 is a perspective view illustrating the printer in which the medium receiving tray is in a second unfolded state.

When the front cover 4 is open, the medium receiving tray 30 is exposed. The medium receiving tray 30 receives discharged recording sheets on which recording has been performed. The medium receiving tray 30 can assume a stored state in which the tray 30 is stored in the apparatus body 2 as illustrated in FIG. 1 and can assume an unfolded state in which the tray 30 is extended and protruded from the apparatus body 2 as illustrated in FIGS. 2 and 3. A motor 41 (see FIG. 9) provides the power for switching the state.

The medium receiving tray 30 will be described later in detail.

Figure 4:
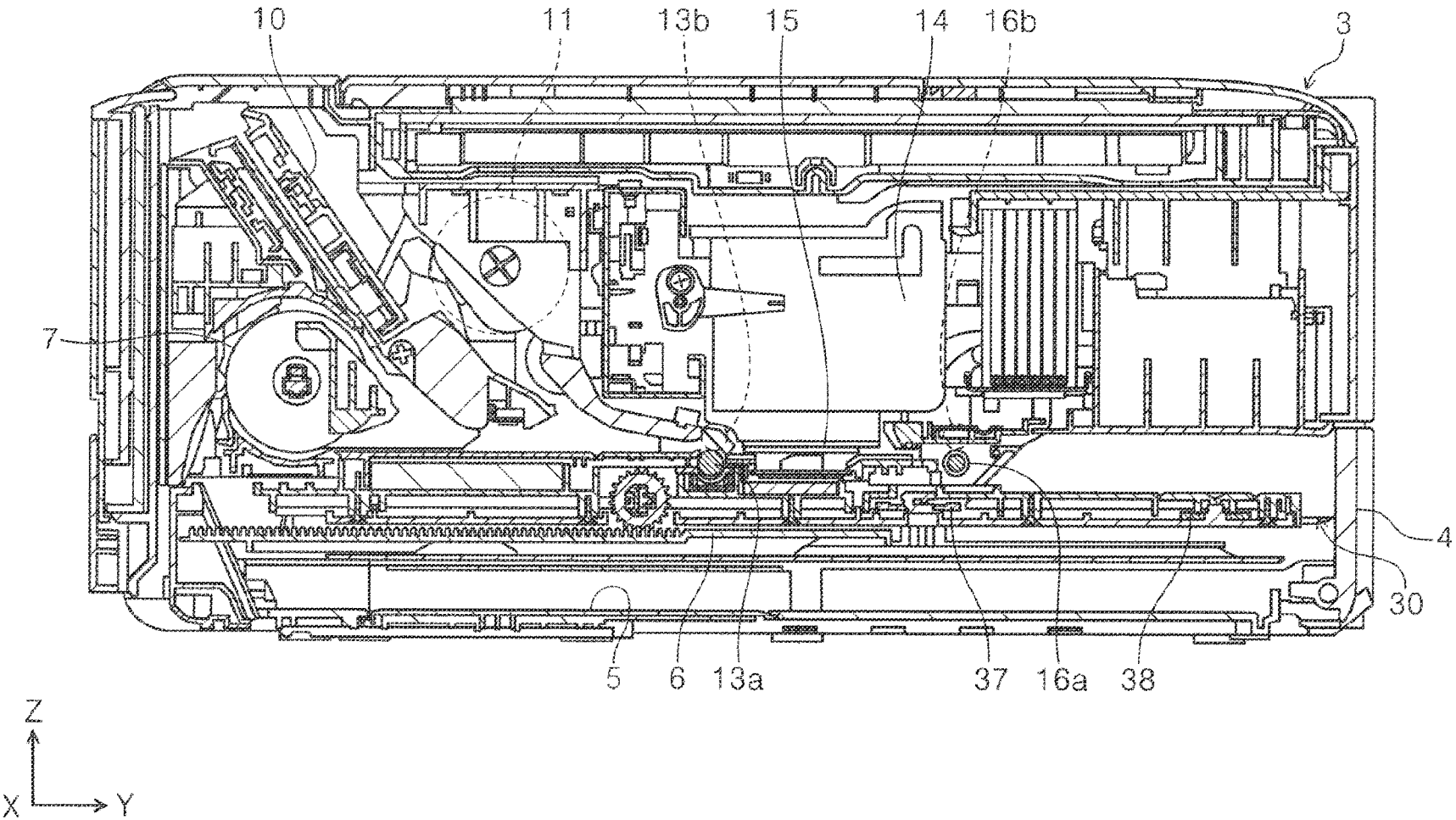
FIG. 4 is a cross-sectional side view illustrating a sheet transport path in the printer.

As illustrated in FIG. 4, an inversion roller 7 is disposed in the apparatus body 2 at a region in the −Y direction. A recording sheet fed in the −Y direction from the lower paper feed tray 5 or the upper paper feed tray 6 is inverted by the inversion roller 7, and subsequently transported toward a transport drive roller 13*a* and a transport idler roller 13*b* that are located in the +Y direction from the inversion roller 7. Reference sign 10 denotes an inclined paper support that is exposed when the top cover 8 is open. A recording sheet supported on the inclined paper support 10 is fed by a feed roller 11 toward the transport drive roller 13*a* and the transport idler roller 13*b*.

The transport drive roller 13*a* and the transport idler roller 13*b* transport the recording sheet to a recording region, in other words, a region opposing the recording head 15.

The recording head 15 is mounted on a carriage 14, and the carriage 14 is reciprocally moved in the X-axis direction by a power source (not illustrated). The recording head 15 ejects ink onto the recording sheet in synchronization with the movement of the carriage 14.

The recording sheet on which recording has been performed is discharged by a discharge drive roller 16*a* and a discharge idler roller 16*b* to the medium receiving tray 30.

Next, the medium receiving tray 30 is described in detail.

The medium receiving tray 30 is configured to be switched between the stored state (see FIG. 1) in which the medium receiving tray 30 is stored in the apparatus body 2 and the unfolded state (see FIG. 3) in which the medium receiving tray 30 is protruded furthest in the +Y direction from the apparatus body 2. The unfolded state includes a first unfolded state (see FIG. 2) and a second unfolded state (see FIG. 3). In the second unfolded state, the medium receiving tray 30 is protruded further in the +Y direction compared with the first unfolded state. The second unfolded state is the state in which the medium receiving tray 30 protrudes furthest from the apparatus body 2.

The stored state is an example of a first state of the medium receiving tray 30, and the second unfolded state is an example of a second state of the medium receiving tray 30.

Figure 5:
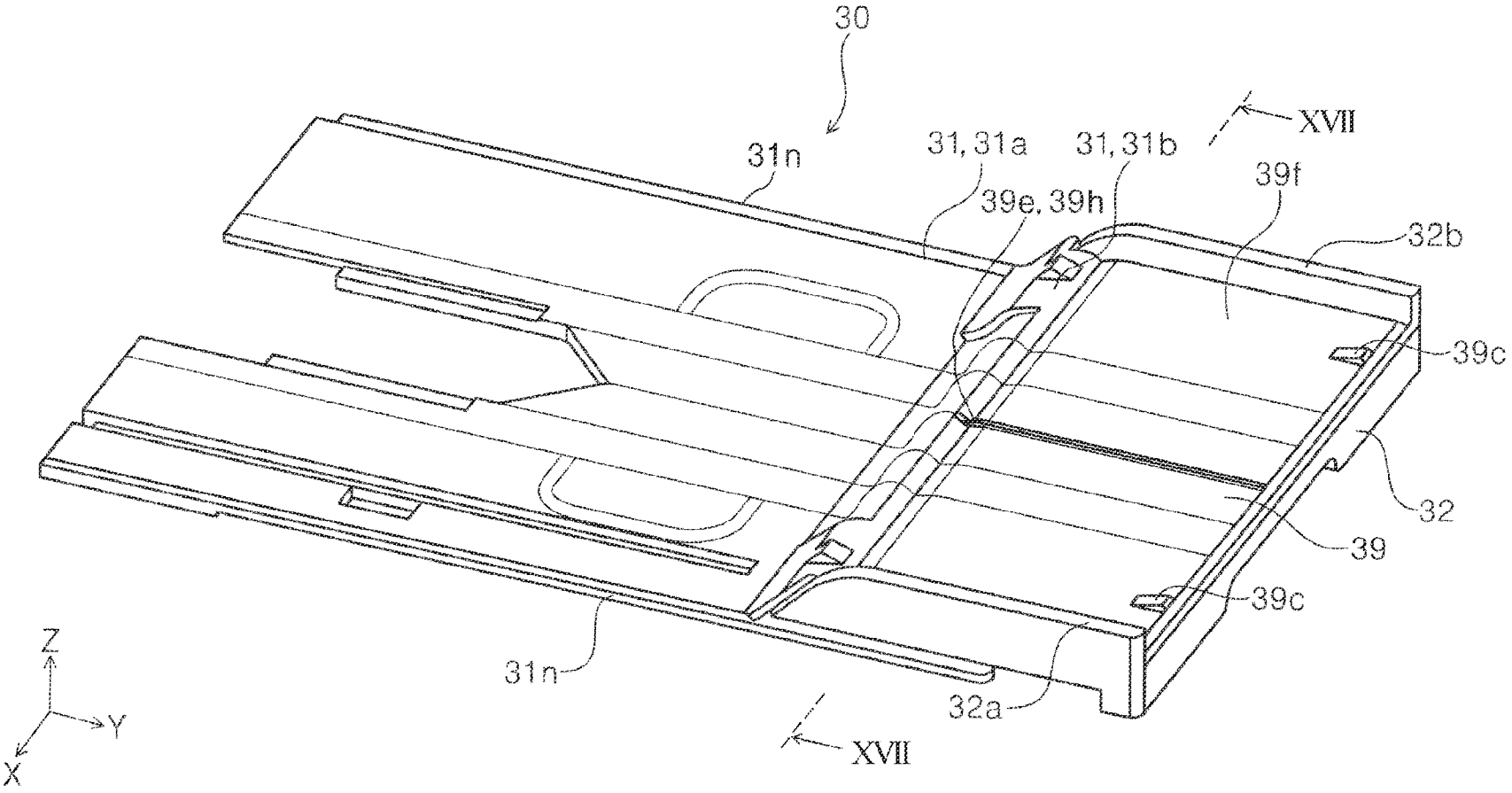
FIG. 5 is a perspective view illustrating the medium receiving tray that is in the stored state or the first unfolded state.
Figure 6:
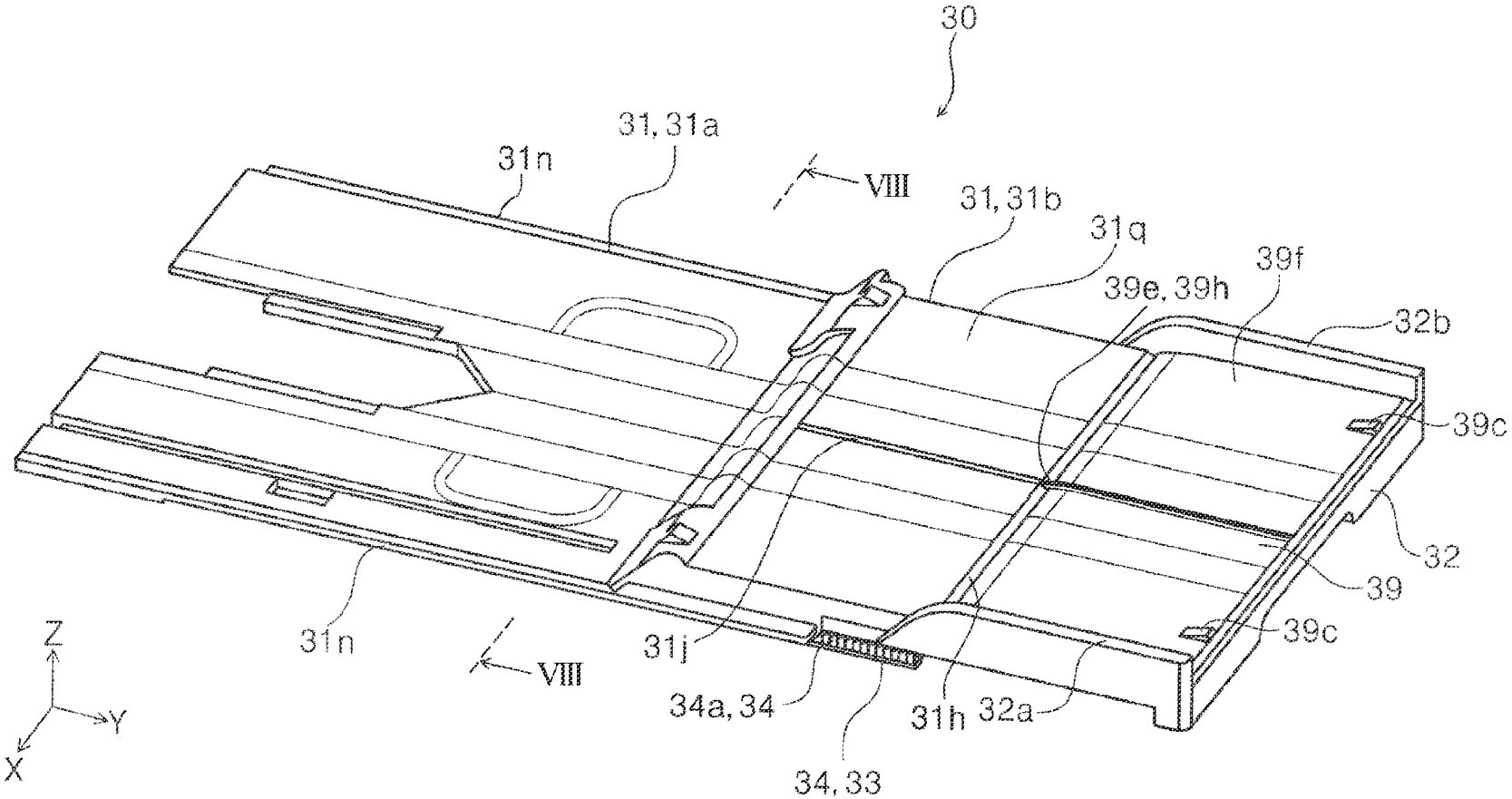
FIG. 6 is a perspective view illustrating the medium receiving tray that is in the second unfolded state.
Figure 7:
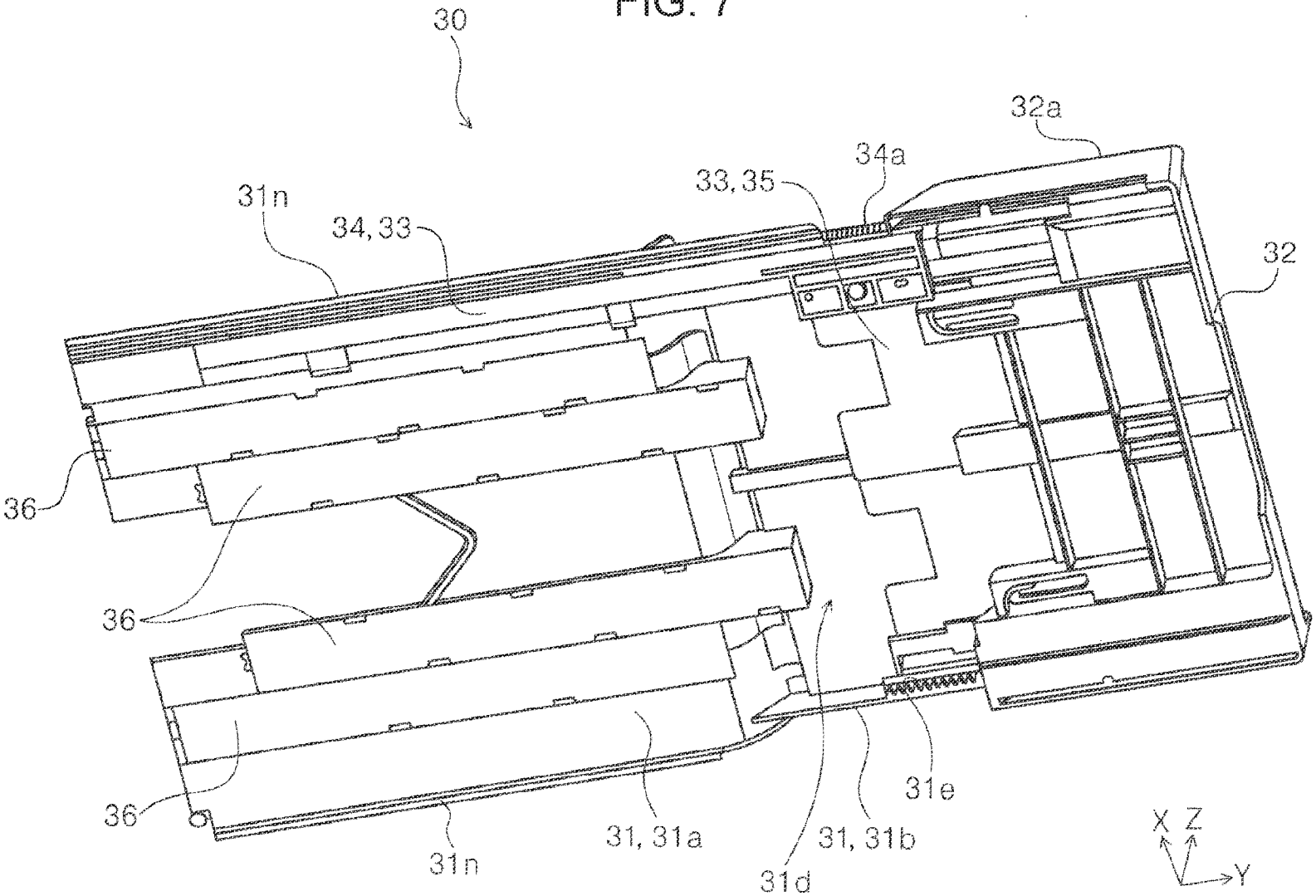
FIG. 7 is a perspective view illustrating the backside of the medium receiving tray that is in the second unfolded state.

As illustrated in FIGS. 5 to 7, the medium receiving tray 30 includes a first tray 31 and a second tray 32. The second tray 32 is displaceable relative to the first tray 31. The second tray 32 is configured to protrude further from the apparatus body 2 than the first tray 31 in the second unfolded state. A movable support 39 is disposed at an upper part of the second tray 32. Recording media are supported on a first support surface 31*q* of the first tray 31 and also on a second support surface 39*f* of the movable support 39. Note that an upper surface of a first portion 31*a* of the first tray 31 also serves as the support surface for supporting the media. The upper surface of the first portion 31*a* is located at a position below the first support surface 31*q* and upstream of the first support surface 31*q* in the sheet transporting direction.

Figure 28:
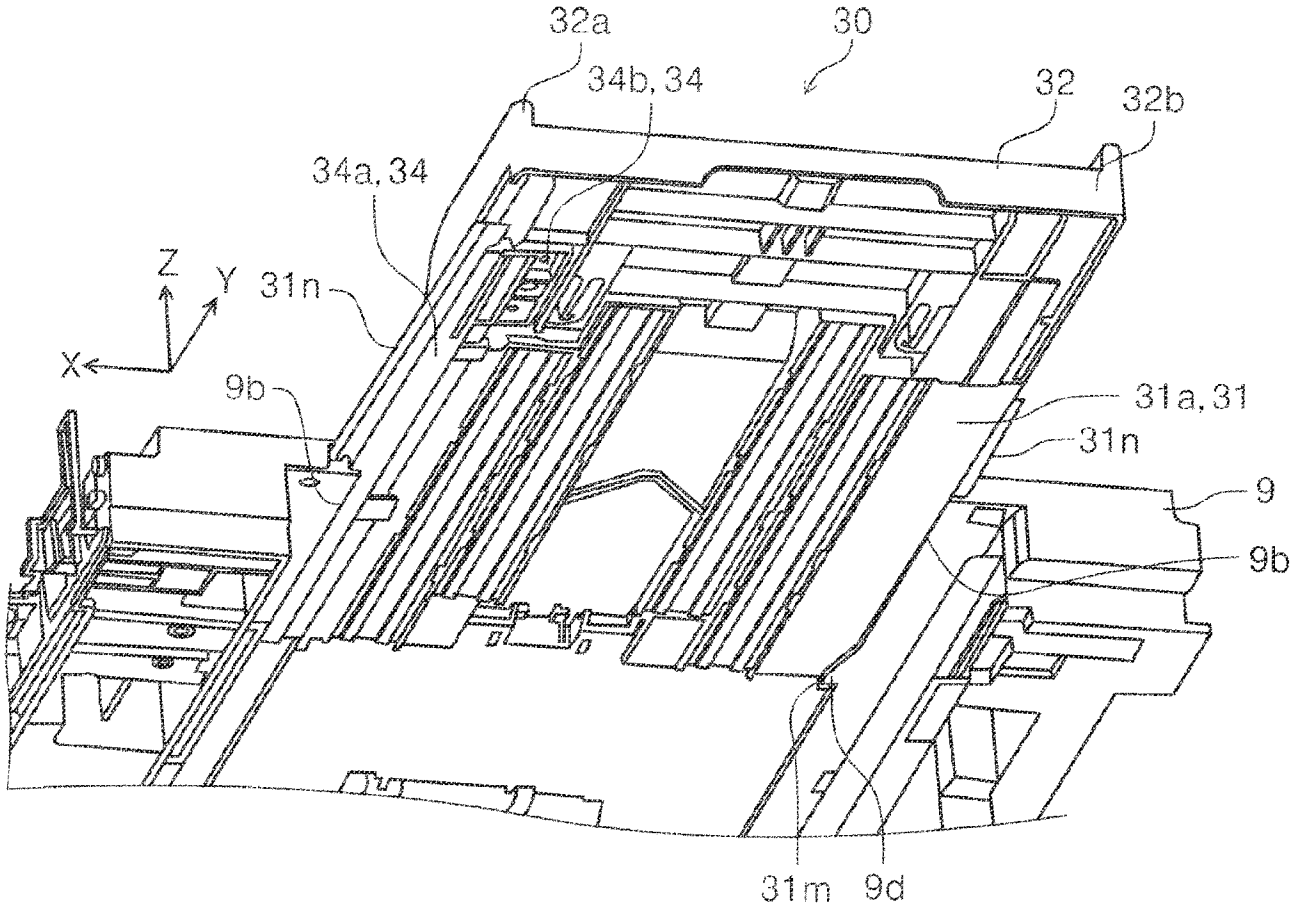
FIG. 28 is a perspective view illustrating the medium receiving tray and a frame that supports the medium receiving tray.

The first tray 31 is disposed in a frame 9, which is part of the apparatus body 2, so as to be slidable relative to the frame 9 (see FIG. 28). The second tray 32 is disposed on the first tray 31 with a gear support member 35 interposed therebetween. The second tray 32 is slidable relative to the first tray 31. The gear support member 35 forms a displacing unit 33.

The displacing unit 33 is formed of a rack forming member 34 illustrated in FIG. 7 and the gear support member 35 that is positioned in the +Y direction from the rack forming member 34. The rack forming member 34 has a fixation portion 34*b* as illustrated in FIG. 13, and the gear support member 35 is fixed to the fixation portion 34*b* by a screw 49 as illustrated in FIG. 9.

Figure 9:
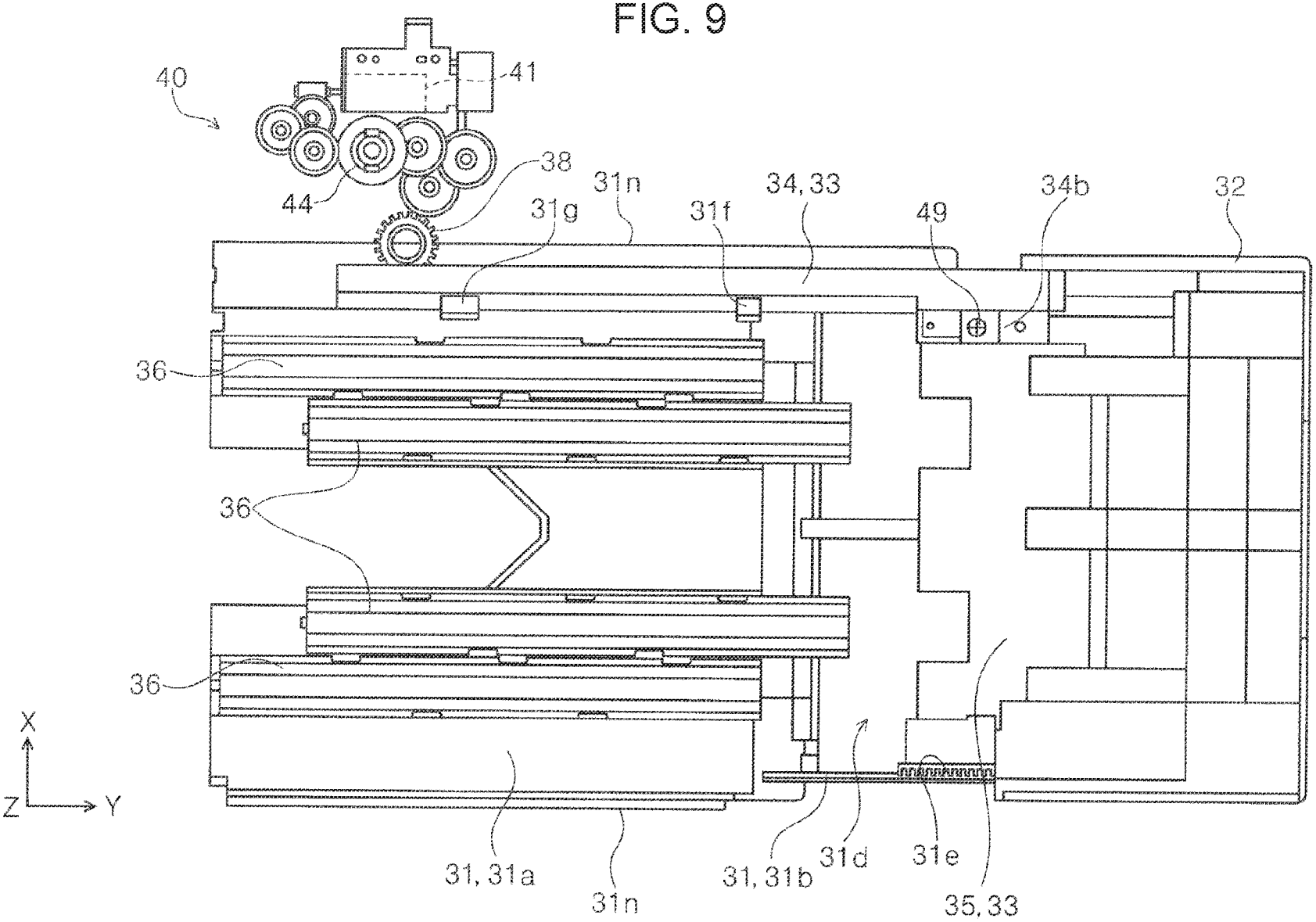
FIG. 9 is a plan view illustrating the backside of the medium receiving tray in the second unfolded state and a transmission gear group.
Figure 10:
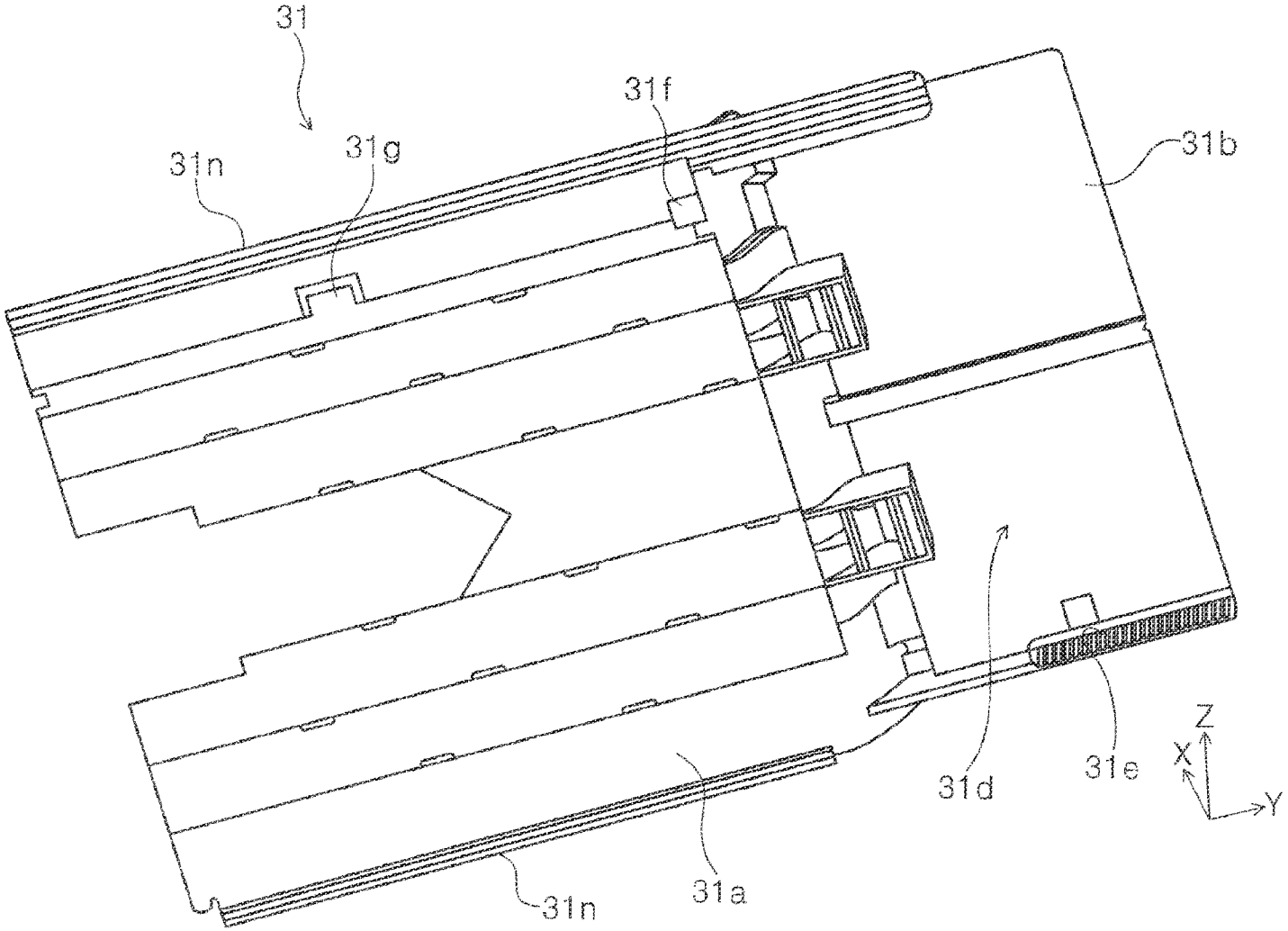
FIG. 10 is a perspective view illustrating the first tray as viewed from below.

As illustrated in FIGS. 7, 9, and 10, supporting portions 31*f* and 31*g* are formed in the first tray 31 so as to be spaced from each other in the Y-axis direction, and the supporting portions 31*f* and 31*g* support the rack forming member 34 of the displacing unit 33.

Figure 17:
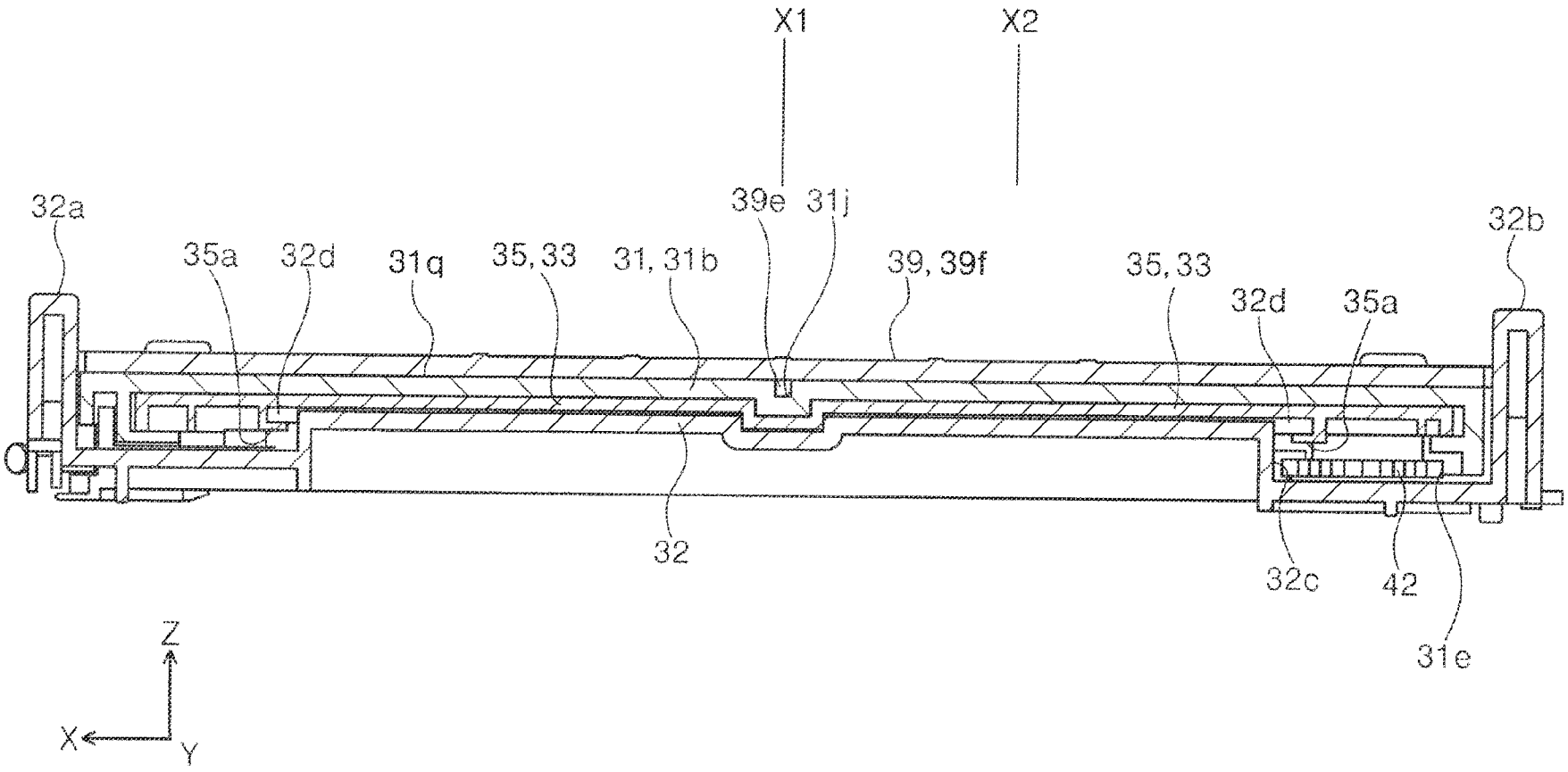
FIG. 17 is a cross section of the medium receiving tray that is cut along line XVII-XVII in FIG. 5.

As illustrated in FIG. 17, other supporting portions 35*a* are also formed in the gear support member 35 of the displacing unit 33 so as to be spaced from each other in the X-axis direction, and the supporting portions 35*a* engage supported portions 32*d* of the second tray 32 to support the second tray 32.

Figure 13:
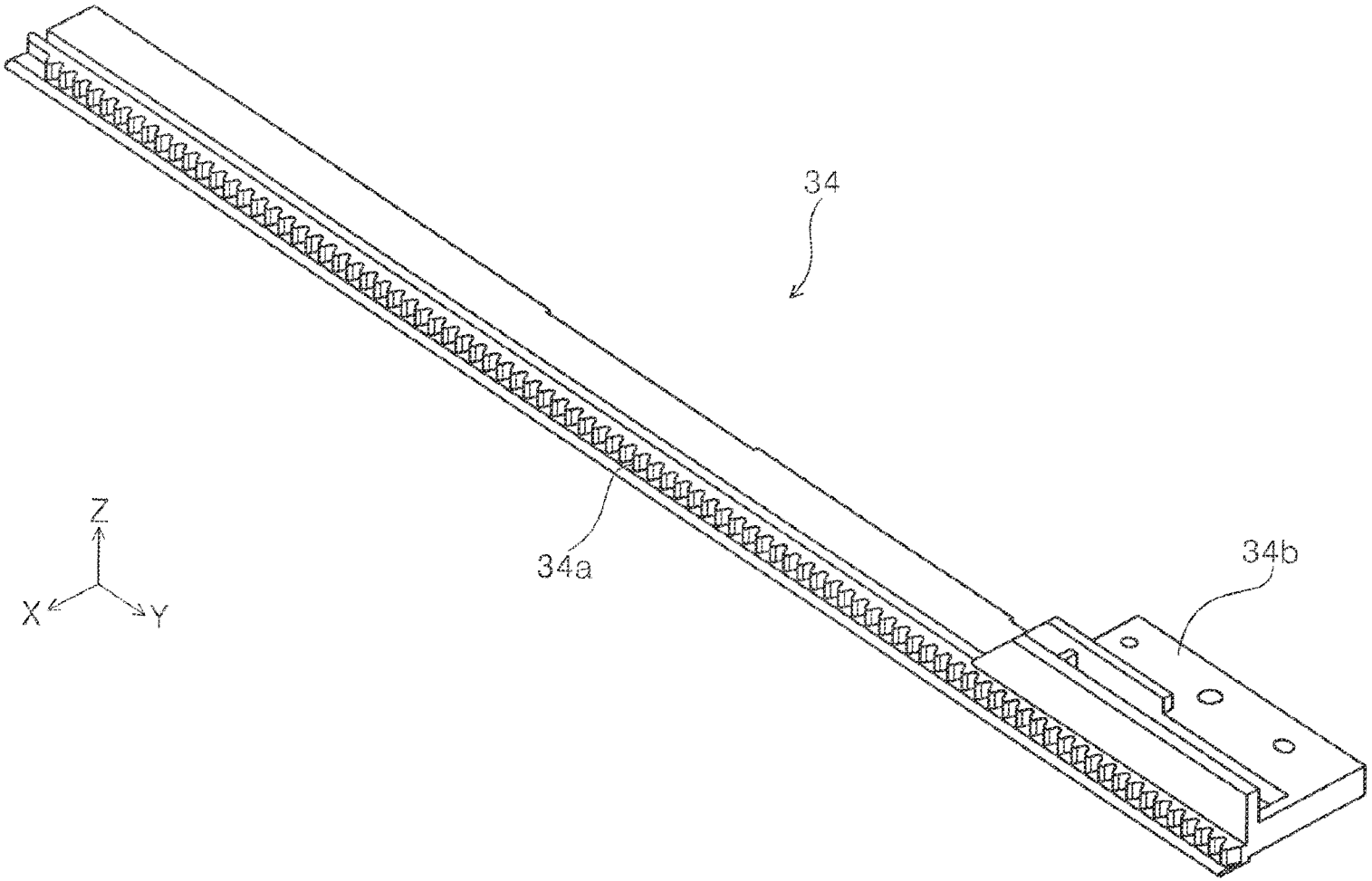
FIG. 13 is a perspective view illustrating a rack forming member as viewed from above.

As illustrated in FIGS. 6 and 13, a third rack 34*a* is formed along the Y-axis in the rack forming member 34 of the displacing unit 33.

As illustrated in FIG. 9, a second pinion gear 38 engages the third rack 34*a* of the rack forming member 34.

The power of the motor 41 is transmitted to the second pinion gear 38 via a transmission gear group 40. The second pinion gear 38 and the third rack 34*a* of the rack forming member 34 form a rack-pinion mechanism, and the rotation of the motor 41 thereby displaces the rack forming member 34 or the displacing unit 33 in the Y-axis direction.

The second pinion gear 38 and the third rack 34*a* of the rack forming member 34 engage each other continuously without any interruption of engagement irrespective of the state of the medium receiving tray 30. This prevents unusual noises from occurring in the rack-pinion mechanism when a disengaged pinion reengages the rack. When a user manually moves the medium receiving tray 30, continuous engagement of the rack and pinion enables a smooth transition from the unfolded state to the stored state, and vice versa.

Note that as illustrated in FIG. 9, the transmission gear group 40 includes a friction clutch 44 that frictionally transmits the power of the motor 41 to the second pinion gear 38. Even if the motor 41 rotates further after the rack forming member 34 reaches a movement limit position in the Y-axis direction, in other words, after completion of the state switching of the medium receiving tray 30, the friction clutch 44 is configured to slip so as not to cause damage to the rack-pinion mechanism. In addition, a single second pinion gear 38 is able to move both of the first tray 31 and the second tray 32, which will be described in detail later. This leads to cost reduction of the apparatus.

Moreover, when the medium receiving tray 30 is moved manually, the friction clutch 44 provides frictional resistance. In the case of the single second pinion gear 38 moving both of the first tray 31 and the second tray 32 simultaneously, only one friction clutch 44 is necessary, which enables a user to manually move the medium receiving tray 30 with less effort.

A tray stopper 9*d* (see FIG. 28) is disposed at the frame 9 that supports the first tray 31. The tray stopper 9*d* limits movement of the first tray 31 in the +Y direction. In FIG. 28, reference sign 31*m* denotes an engagement portion of the first tray 31. The engagement portion 31*m* engages the tray stopper 9*d*.

In the stored state in which the medium receiving tray 30 is stored as illustrated in FIG. 1, rotation of the motor 41 causes the entire medium receiving tray 30 to move in the +Y direction (see FIG. 9) from the position in FIG. 1 to the position in FIG. 2. When the medium receiving tray 30 moves from the position in FIG. 1 to the position in FIG. 2, the positional relationship between the first tray 31 and the second tray 32 does not change.

In the first unfolded state illustrated in FIG. 2, the medium receiving tray 30 can receive, for example, A4 sheets with the longitudinal direction thereof aligning with the Y-axis direction.

In the first unfolded state illustrated in FIG. 2, the first tray 31 has reached the movement limit position in the +Y direction. Further rotation of the motor 41 in this state causes the displacing unit 33 and the second tray 32 to move together in the +Y direction while the first tray 31 stops so that the medium receiving tray 30 assumes the second unfolded state as illustrated in FIG. 3.

In the second unfolded state illustrated in FIG. 3, the medium receiving tray 30 can receive, for example, A3 sheets with the longitudinal direction thereof aligning with the Y-axis direction.

Figure 14:
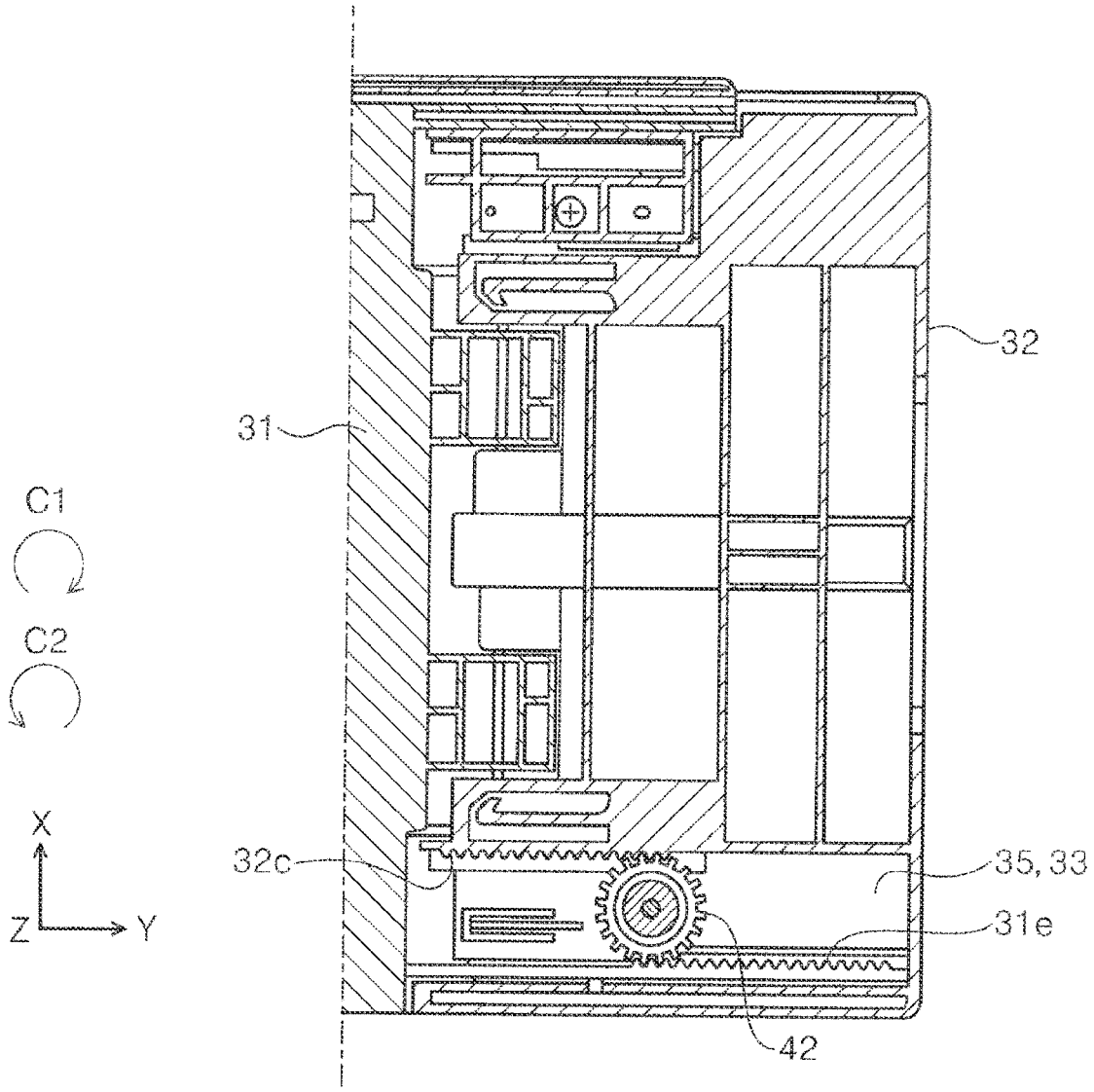
FIG. 14 is a cross section of the medium receiving tray that is cut along an X-Y plane.

Here, as illustrated in FIGS. 14 and 15, a first rack 31*e* is formed in the first tray 31 along the Y-axis, and a second rack 32*c* is formed in the second tray 32 along the Y-axis. A first pinion gear 42 is rotatably supported by the gear support member 35 of the displacing unit 33, and the first pinion gear 42 engages both of the first rack 31*e* and the second rack 32*c*.

FIG. 14 also illustrates the first unfolded state of FIG. 2. In this state, the rotation of the motor 41 causes the displacing unit 33 or the gear support member 35 to move in the +Y direction while the first tray 31 stops. Here, due to the first pinion gear 42 engaging the first rack 31*e*, the first pinion gear 42 rotates in the C1 direction in FIGS. 14 and 15. The rotation is transmitted to the second rack 32*c*, which causes the second tray 32 to move in the +Y direction from the position in FIG. 14 to the position in FIG. 15 and thereby switches the medium receiving tray 30 into the second unfolded state.

In short, the first pinion gear 42 is disposed between the first tray 31 and the second tray 32. The gear support member 35 (displacing unit 33) and the first pinion gear 42 supported by the gear support member 35 are moved together in the Y-axis direction, and the movement of the gear support member 35 rotates the first pinion gear 42 and thereby moves the second tray 32. With this configuration, the amount of displacement of the second tray 32 can be increased relative to the amount of displacement of the displacing unit 33. This can reduce the time required for the medium receiving tray 30 to be switched from the stored state to the unfolded state, and vice versa.

In addition, this enables the second pinion gear 38 to be positioned further in the −Y direction (see FIG. 9). This leads to a reduction in the size of the apparatus body 2 in the Y-axis direction.

When the motor 41 rotates reversely, the displacing unit 33 or the gear support member 35 moves in the −Y direction, and the first pinion gear 42 rotates in the C2 direction in FIGS. 14 and 15. The second tray 32 is thereby moved in the −Y direction from the position in FIG. 15 to the position in FIG. 14.

Figure 18:
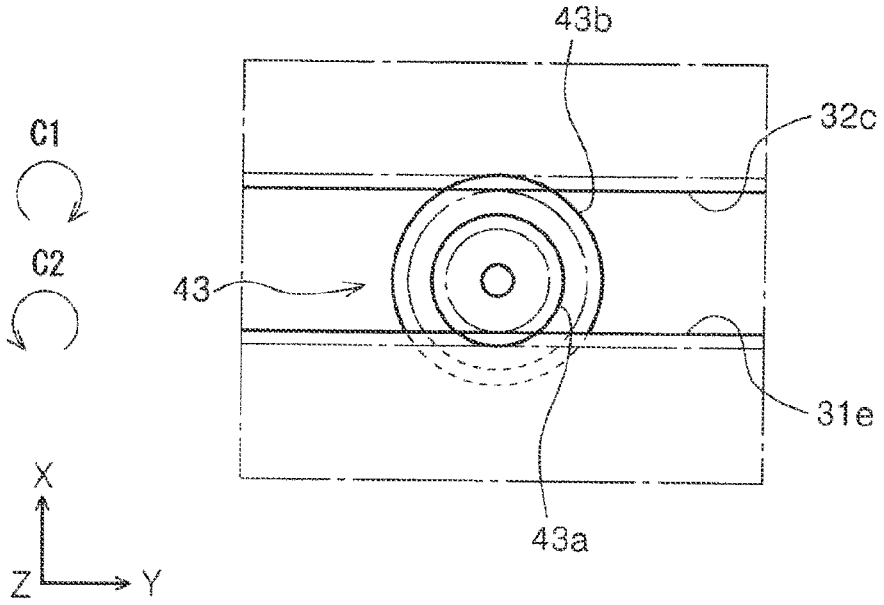
FIG. 18 is a view illustrating another embodiment of a pion gear interposed between the first tray and the second tray.

The above-described first pinion gear 42 may be formed preferably as a composite gear 43 as illustrated in FIG. 18. The composite gear 43 is a pinion gear integrally formed of a first pinion portion 43*a* that engages the first rack 31*e* and a second pinion portion 43*b* that engages the second rack 32*c*. The second pinion portion 43*b* has a larger diameter and a larger number of teeth compared with the first pinion portion 43*a*.

This can increase the amount of protrusion of the second tray 32 relative to the amount of rotation of the composite gear 43 that serves as the first pinion gear. This can further reduce the time required for the medium receiving tray 30 to be switched to the unfolded state.

The configuration of the medium receiving tray 30 is described further below.

Figure 8:
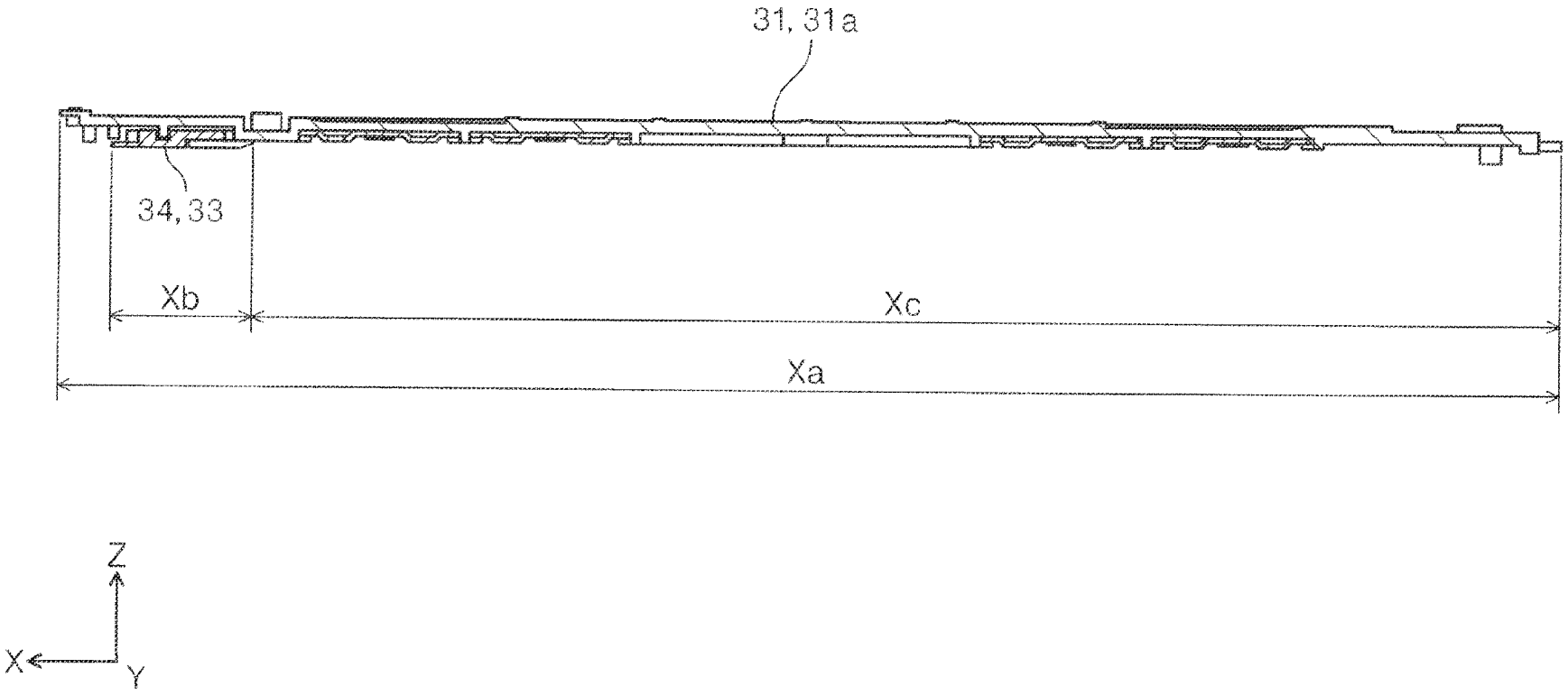
FIG. 8 is a cross section of the medium receiving tray that is cut along line VIII-VIII in FIG. 6.

The displacing unit 33 is formed of the rack forming member 34 and the gear support member 35. As illustrated in FIG. 7, the rack forming member 34 has the third rack 34*a* formed so as to extend in the Y-axis direction, which is the displacement direction of the medium receiving tray 30. The gear support member 35 is positioned further in the +Y direction (i.e., in the medium discharging direction) with respect to the rack forming member 34. The gear support member 35 rotatably supports the first pinion gear 42 (see FIGS. 14 and 15). In addition, in the width direction, which is the direction intersecting the Y-axis direction (i.e., in the X-axis direction), the rack forming member 34 is formed near a side of the first tray 31 (near the side positioned in the +X direction) as illustrated in FIG. 8. In FIG. 8, in the X-axis direction, a region Xa represents a region that the first tray 31 occupies, and a region Xb represents a region that the rack forming member 34 occupies. A region Xc represents a region of the first tray 31 excluding the rack forming member 34. With the above configuration, an increase in the thickness of the medium receiving tray 30 due to the presence of the thick rack forming member 34 can be avoided in the region Xc, which leads to a reduction in the height of the apparatus body 2.

Especially in the present embodiment, the presence of the upper paper feed tray 6 below the first tray 31 (see FIG. 4) tends to increase the height of the apparatus body 2. An increase in the height of the apparatus body 2 can be suppressed by suppressing an increase in the thickness of the medium receiving tray 30.

Figure 11:
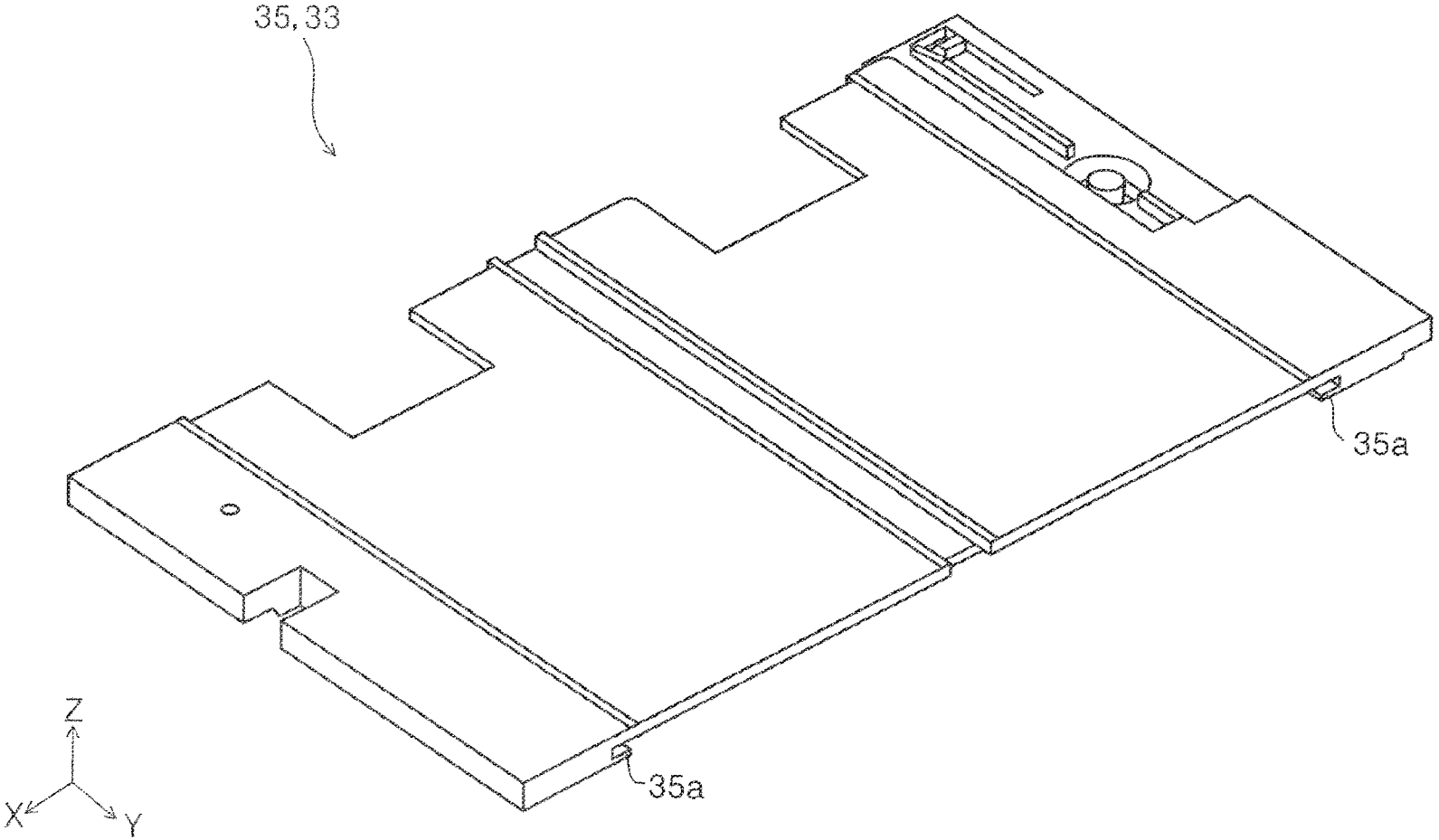
FIG. 11 is a perspective view illustrating a gear support member as viewed from above.
Figure 12:
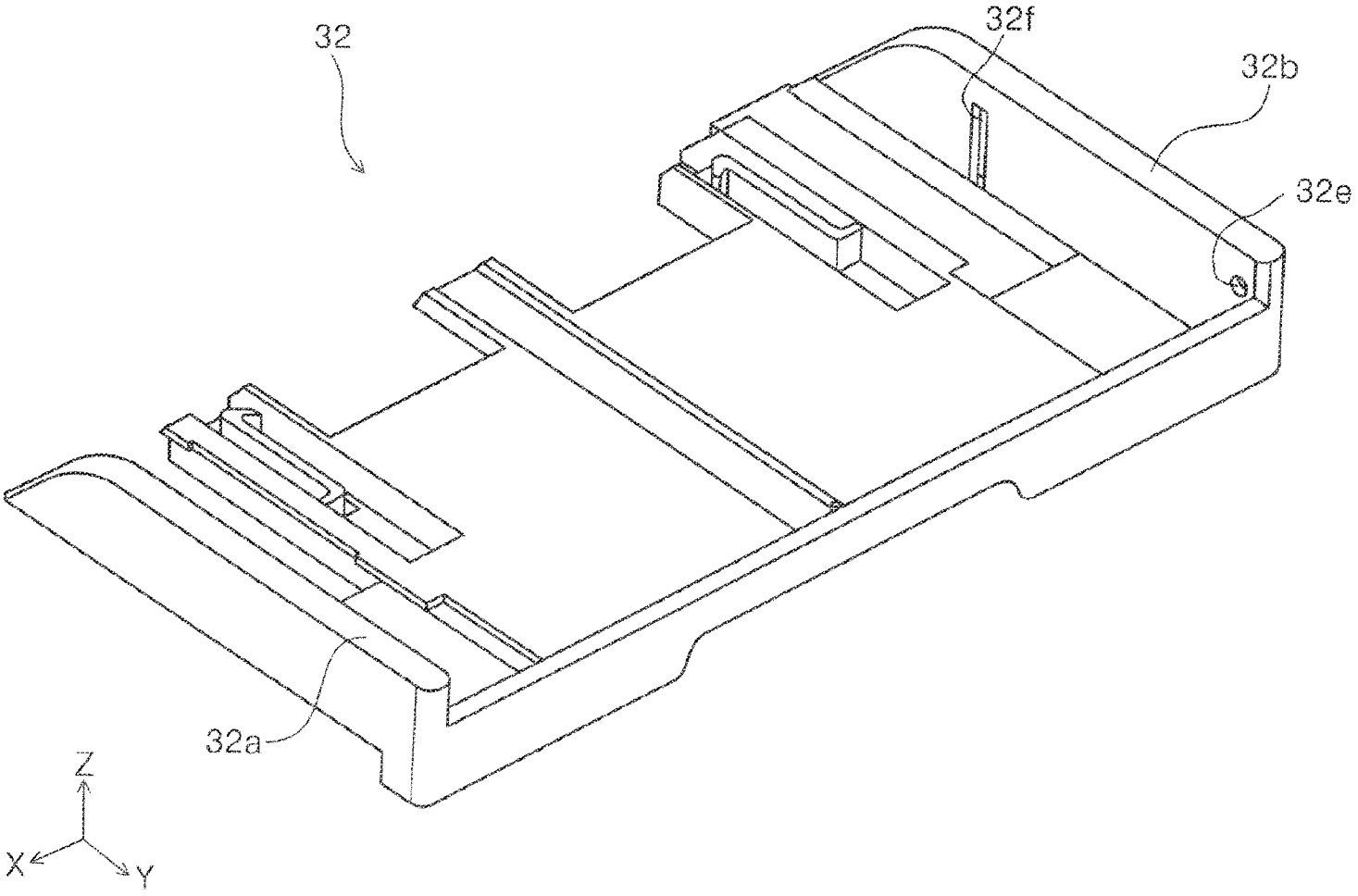
FIG. 12 is a perspective view illustrating a second tray as viewed from above.

The gear support member 35 of the displacing unit 33, which is shaped like a tray as illustrated in FIG. 11, is sandwiched between the first tray 31 and the second tray 32 as illustrated in FIGS. 7 and 17. This can increase the overall rigidity of the medium receiving tray 30.

Reinforcing members 36 are also disposed beneath the first tray 31 so as to extend in the Y-axis direction and so as to be arranged side by side in the X-axis direction as illustrated in FIGS. 7 and 9. For example, the reinforcing members 36 can be formed of a metal plate to increase the overall rigidity of the medium receiving tray 30.

In the present embodiment, the second tray 32 and the displacing unit 33 are supported by the first tray 31. Accordingly, the entire medium receiving tray 30 can be assembled as a single unit, which leads to simplification of apparatus assembly.

As illustrated in FIGS. 5 to 7 and 10, the first tray 31 is formed of a first portion 31*a* and a second portion 31*b*. With respect to the first portion 31*a*, the second portion 31*b* is positioned further in the discharging direction of the medium from the apparatus body 2 (i.e., in the +Y direction). The second portion 31*b* has a height greater than that of the first portion 31*a*. As illustrated in FIG. 7, the second tray 32 and the gear support member 35 are disposed in a lower side space 31*d* of the second portion 31*b*. This can suppress an increase in the thickness (i.e., the dimension in the Z-axis direction) of the medium receiving tray 30.

Figure 16:
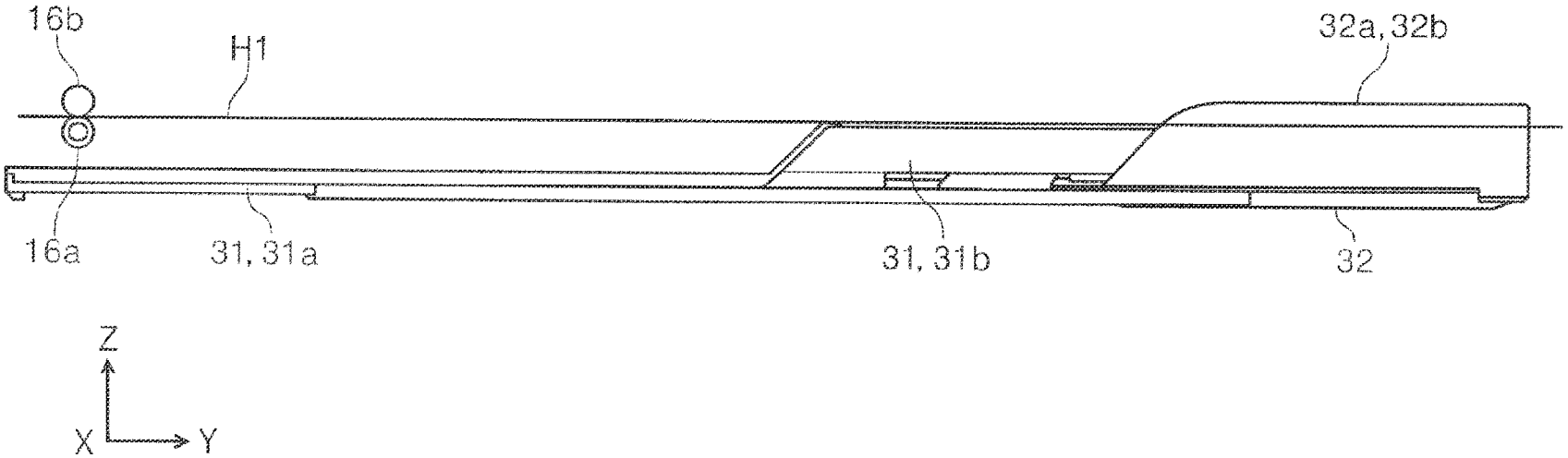
FIG. 16 is a side view illustrating the medium receiving tray.

As illustrated in FIGS. 2, 3, 5, 6, and 12, the second tray 32 has a side wall 32*a* at one side thereof and a side wall 32*b* at the other side in the X-axis direction. As illustrated in FIG. 16, the side walls 32*a* and 32*b* are formed so as to have a height higher than the height of a nip position H1 between the discharge drive roller 16*a* and the discharge idler roller 16*b*. The upstream end (an end in the −Y direction) of a recording sheet discharged thereby does not rise easily from the medium receiving tray 30, which can suppress the likelihood of a discharged recording sheet pushing the previously one out of the tray.

When a recording sheet that bends easily, such as a sheet of plain paper, is discharged onto the medium receiving tray 30, the recording sheet proceeds downstream while the side walls 32*a* and 32*b* support the widthwise ends of the recording sheet (i.e., both ends along the X-axis). At the same time, a central portion of the recording sheet bends downward and comes into contact with the first support surface 31*q* of the first tray 31 and the second support surface 39*f* of the movable support 39.

Figure 20:
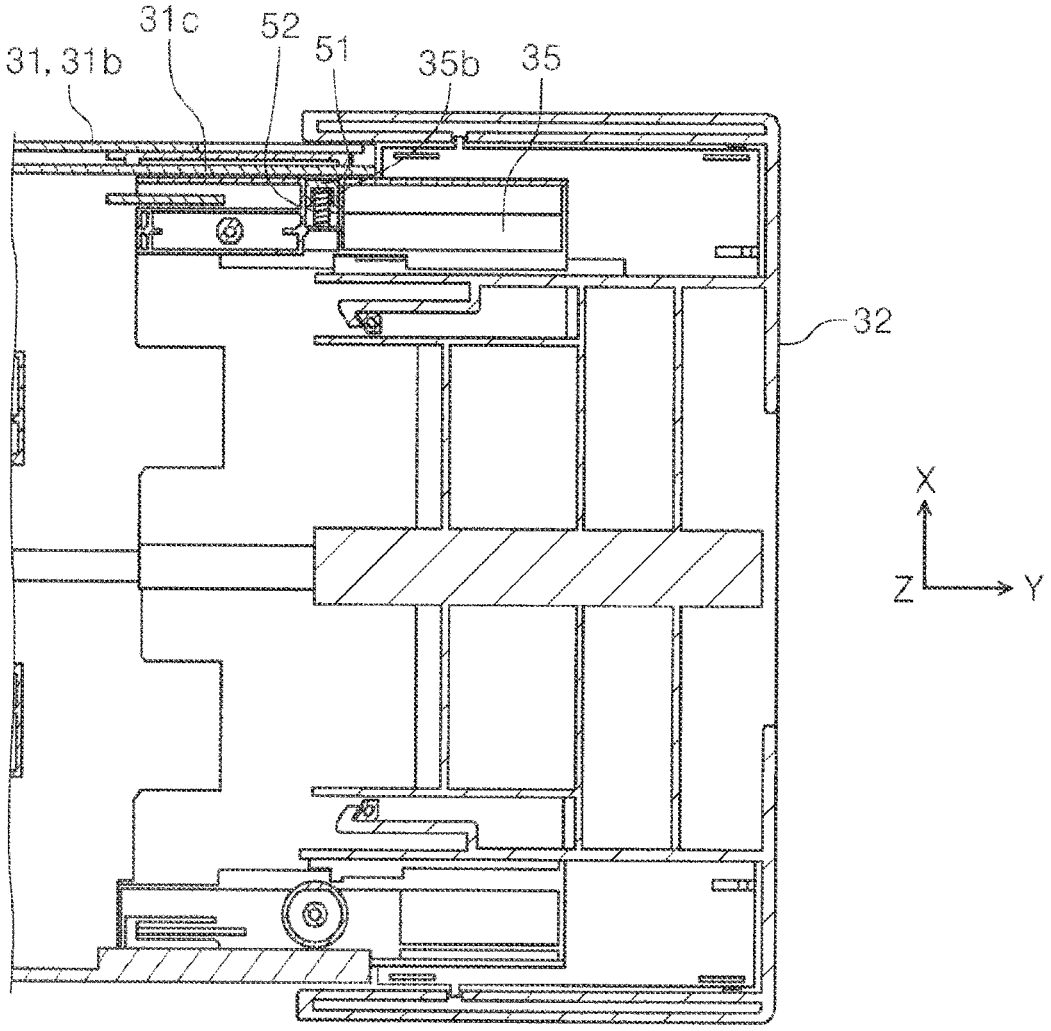
FIG. 20 is a cross section of the medium receiving tray that is cut along an X-Y plane so as to expose a friction member.

Next, a device for generating friction between the first tray 31 and the displacing unit 33 is described. As illustrated in FIG. 20, a recess 35*b* is formed in the gear support member 35 of the displacing unit 33, and a compression spring 52 and a friction member 51 are disposed in the recess 35*b*. The compression spring 52, which is an example of a pressing member, presses the friction member 51 against a wall portion 31*c* that is part of the first tray 31. The friction member 51 can be made of cork or rubber. The friction necessary between the first tray 31 and the displacing unit 33 is generated by pressing the friction member 51 against the wall portion 31*c*, which is part of the first tray 31.

Here, as illustrated in FIG. 28, the first tray 31 has supported portions 31*n* at opposite sides of the first tray 31 in the X-axis direction. The supported portions 31*n* extend in the Y-axis direction. The supported portions 31*n* are supported by supporting portions 9*b* of the frame 9 or the base frame of the printer 1.

Figure 29:
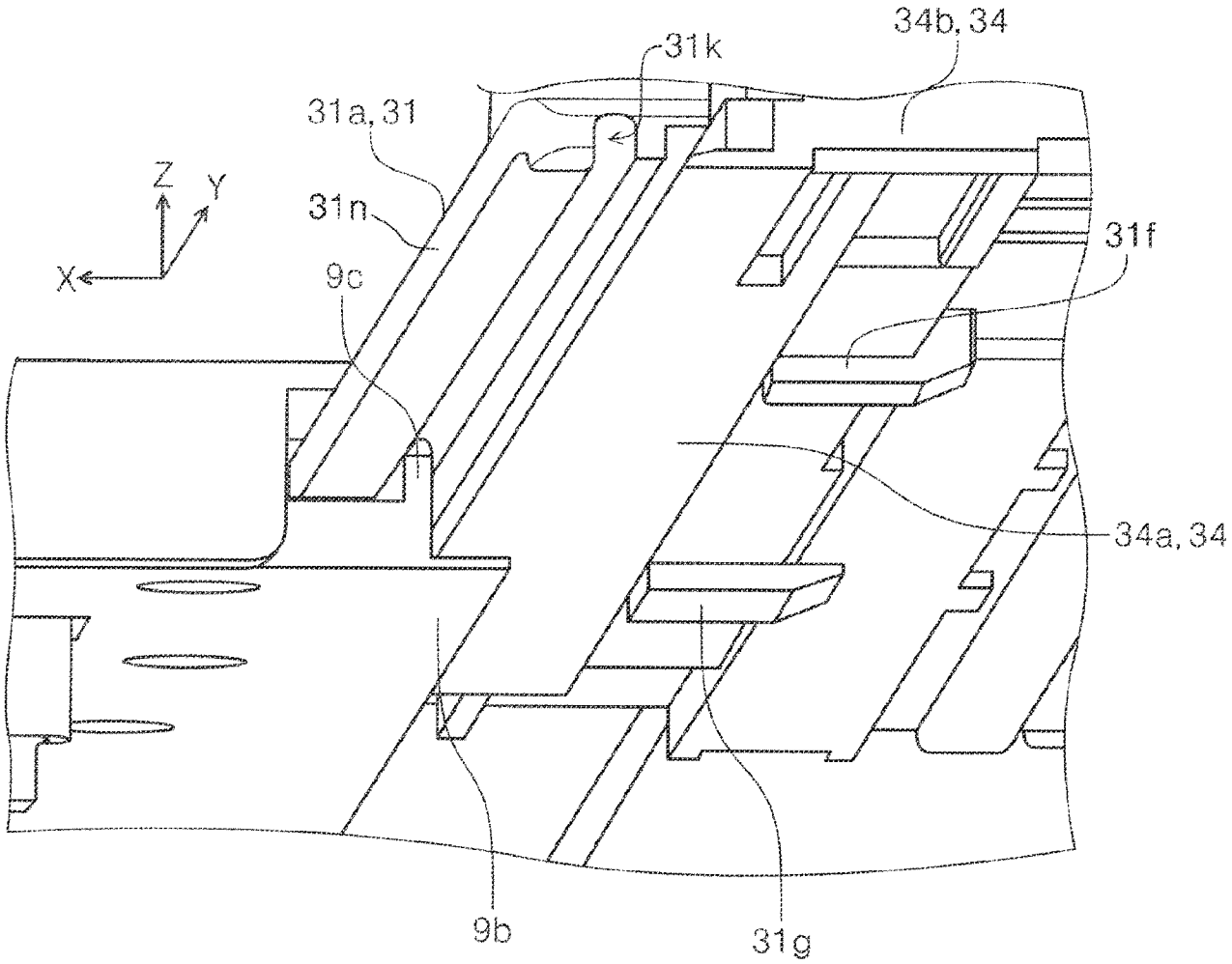
FIG. 29 is an enlarged perspective view partially illustrating the frame supporting the medium receiving tray.
Figure 30:
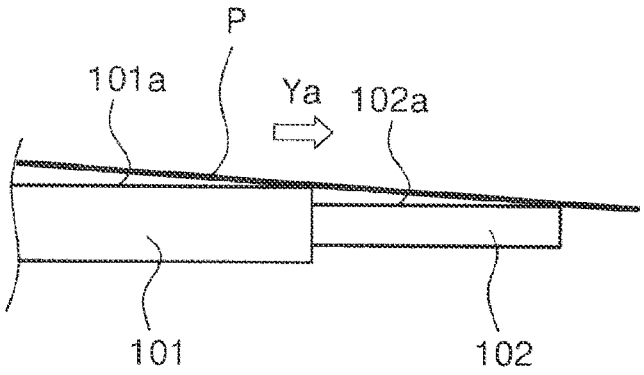
FIG. 30 is a schematic view for explanation of a problem in a known art.

The supporting portions 9*b* of the frame 9 have respective ribs 9*c* that are formed so as to extend in the Y-axis direction, as illustrated in FIG. 29. Grooves 31*k* are formed in respective supported portions 31*n* of the first tray 31 so as to extend in the Y-axis direction. The ribs 9*c* engage corresponding grooves 31*k*. In other words, the friction between the first tray 31 and the frame 9 are mostly generated between the ribs 9*c* and the grooves 31*k*.

When the rotation of the motor 41 (see FIG. 9) causes the displacing unit 33 to move in the +Y direction from the position at which the medium receiving tray 30 is in the stored state, if the friction between the first tray 31 and the displacing unit 33 is smaller than the friction between the first tray 31 and the frame 9, the first tray 31 will not move relative to the frame 9, in other words, will not protrude from the frame 9. Instead, the second tray 32 will start to protrude. When the medium receiving tray 30 in the first unfolded state is used to receive media (see FIG. 2), the medium receiving tray 30 becomes stronger and can resist bending more in the case in which the first tray 31 is protruded but the second tray 32 remains unprotruded compared with the case in which the second tray 32 is protruded but the first tray 31 remains unprotruded. Accordingly, it is not preferable that the second tray 32 be protruded as above with the first tray 31 remaining unmoved with respect to the frame 9.

In the present embodiment, however, the friction member 51 is provided to cause the friction between the first tray 31 and the displacing unit 33 to be greater than the friction between the first tray 31 and the frame 9. The friction member 51 is pressed by the compression spring 52 against the wall portion 31*c* of the first tray 31 to increase the friction between the first tray 31 and the displacing unit 33. Note that the "friction" as used herein is meant to include both dynamic friction and static friction.

Accordingly, when the displacing unit 33 is displaced in the +Y direction by rotating the motor 41 while the medium receiving tray 30 is in the stored state, the displacing unit 33 is displaced together with the first tray 31. In other words, the first tray 31 can be extended before the second tray 32 is extended. This leads to cost reduction of the apparatus since it is not necessary to provide an additional drive mechanism to extend the first tray 31 separately before the second tray.

In the case of a user moving the second tray 32 in the −Y direction manually to store the medium receiving tray 30 when the medium receiving tray 30 is in the second unfolded state (see FIG. 3), the second tray 32 is displaced first in the −Y direction while the first tray 31 remains protruded due to the above-described frictional relationship. Subsequently, the first tray 31 is displaced together with the second tray 32 in the −Y direction, and the medium receiving tray 30 is thereby switched to the stored state.

Here, the user receives reaction from the medium receiving tray 30. The reaction mainly comes from the friction clutch 44 disposed in the transmission gear group 40 (see FIG. 9). In a case of a pinion gear being provided to move the first tray 31, another friction clutch 44 would be necessary for this pinion gear. In such a case, when the user manually moves the second tray 32 in the −Y direction to switch the medium receiving tray 30 into the stored state, the user would receive reaction from two friction clutches, which causes the user to make more effort to do so. In the present embodiment, however, a single second pinion gear 38 (see FIG. 9) is able to displace and extend the first tray 31 and the second tray 32 in a controlled manner, which can suppress an increase in the operational effort when the user switches the medium receiving tray 30 to the stored state by pushing the second tray 32 in the −Y direction.

Figure 21:
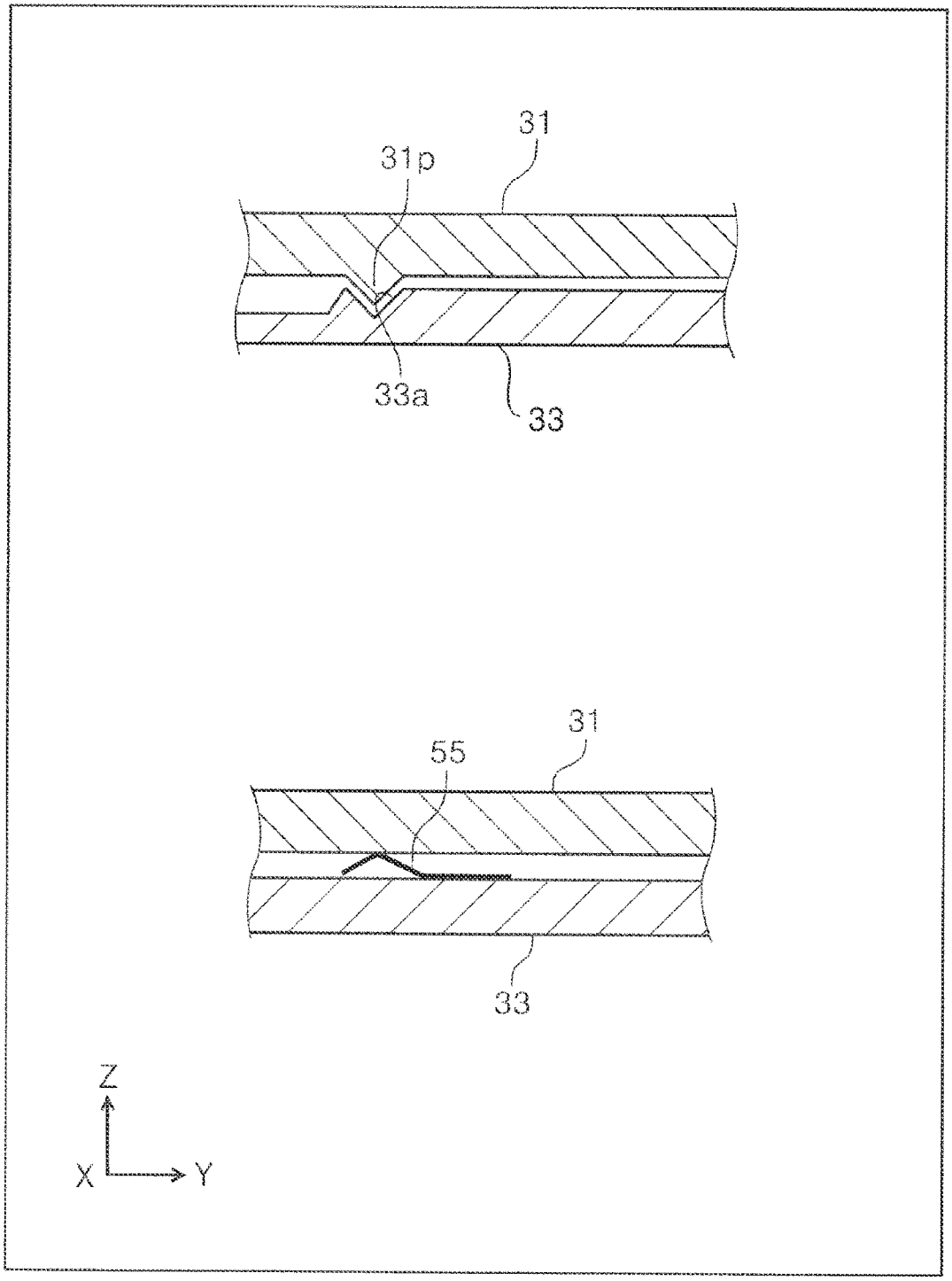
FIG. 21 is a cross-sectional view illustrating a modified example of a device that generates friction between the first tray and a displacing unit.

In the above embodiment, the friction member 51 and the compression spring 52 are used to increase the friction between the first tray 31 and the displacing unit 33. In place of this configuration, the friction between the first tray 31 and the displacing unit 33 may be increased using engagement between a protrusion 31*p* of the first tray 31 and a recess 33*a* of the displacing unit 33 as illustrated in the upper figure of FIG. 21. Alternatively, as illustrated in the lower figure of the FIG. 21, a leaf spring 55 may be provided between the first tray 31 and the displacing unit 33 to increase the friction between the first tray 31 and the displacing unit 33.

Figure 19:
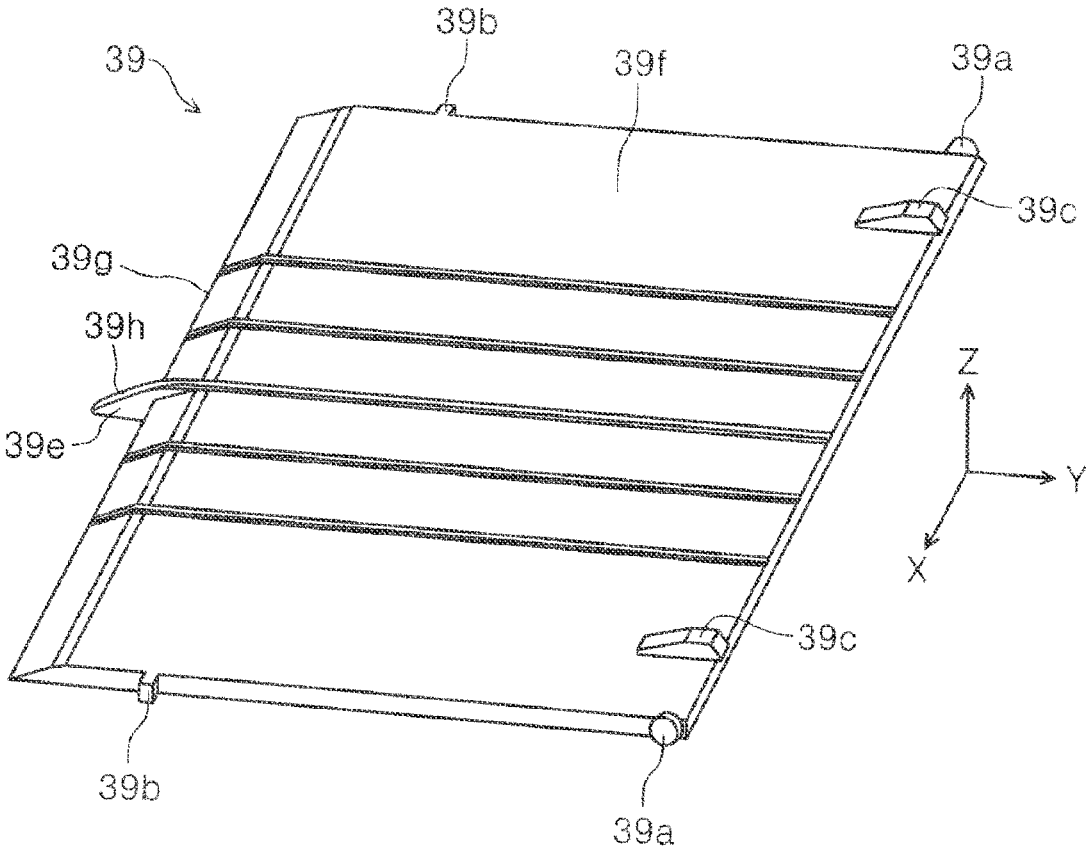
FIG. 19 is a perspective view illustrating a movable support.
Figure 25:
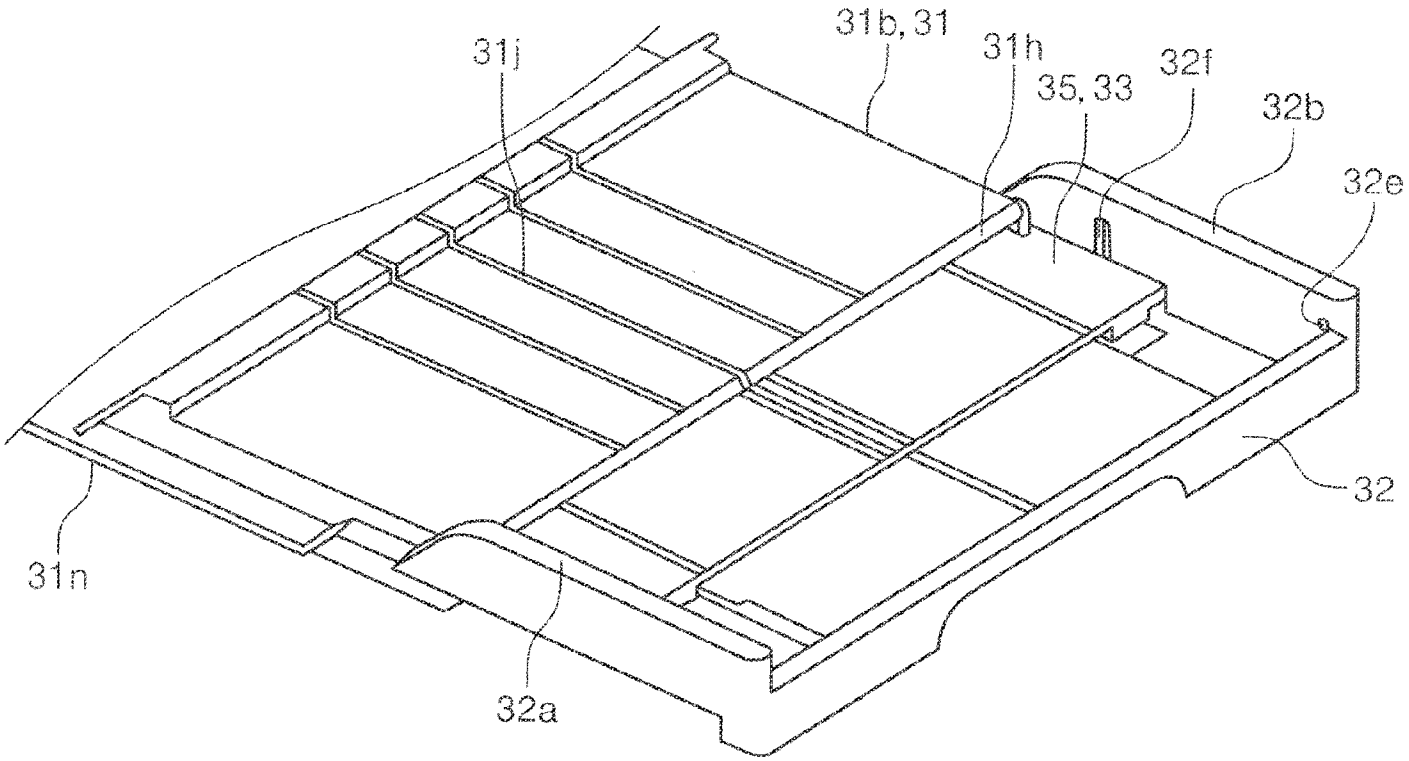
FIG. 25 is a perspective view illustrating the medium receiving tray in the second unfolded state, from which the movable support is removed.

Next, the movable support 39 disposed in the second tray 32 is described in detail. The movable support 39 is shaped like a tray as illustrated in FIG. 19, and has pivot shafts 39*a* formed so as to be positioned in the +Y direction, in other words, downstream in the medium discharging direction. In the X-axis direction, the pivot shafts 39*a* are disposed at opposite ends of the movable support 39, in other words, at the widthwise ends of the movable support 39. The pivot shafts 39*a* of the movable support 39 engage respective shaft support portions 32*e* formed as recesses in the second tray 32 (see FIGS. 12 and 25). The movable support 39 is thereby rotatably attached to the second tray 32. Note that although a single shaft support portion 32*e* positioned at the end of the second tray 32 in the −X direction is only shown in FIGS. 12 and 15, the shaft support portion 32*e* is also formed at the other end in the +X direction. Note that the same applies to guide grooves 32*f*, which will be described later.

The rotation axis of the movable support 39 is disposed parallel to the X-axis. The movable support 39 rotates so as to have a free end 39*g* at the upstream end of the movable support 39 in the medium discharging direction, in other words, at the end of the movable support 39 positioned in the −Y direction.

Protrusions 39*b* are also formed in the movable support 39 at opposite ends thereof in the X-axis direction, in other words, at widthwise ends. The protrusions 39*b* engage respective guide grooves 32*f* that are formed in the second tray 32 so as to extend in the Z-axis direction (see FIGS. 12 and 25), which thereby limits movement (especially upward movement) of the free ends 39*g*.

Figure 26:
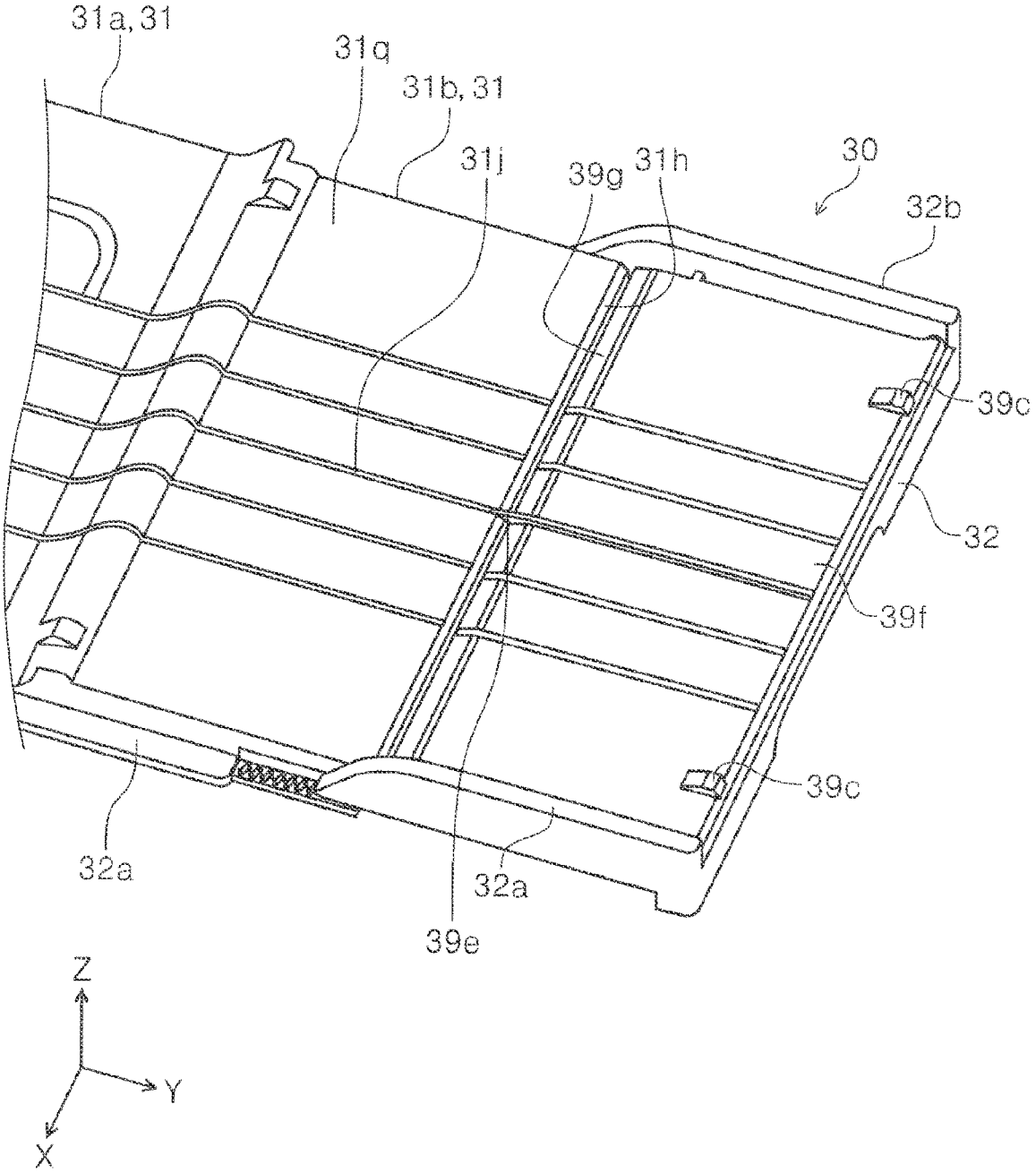
FIG. 26 is a perspective view illustrating the medium receiving tray in the second unfolded state.

When the medium receiving tray 30 is in the second unfolded state, the upper surface of the second portion 31*b* of the first tray 31 serves as the first support surface 31*q* for supporting the recording medium, as illustrated in FIG. 26. The upper surface of the movable support 39 serves as the second support surface 39*f* for supporting the recording medium. Guide protrusions 39*c* are formed on the second support surface 39*f* at positions downstream in the medium discharging direction, in other words, in the +Y direction. The guide protrusions 39*c* are spaced from each other in the X-axis direction or in the width direction. The guide protrusions 39*c* is able to position discharged media diagonally upward. When a plate-like medium having a high rigidity is manually fed from the front side of the apparatus, the medium receiving tray 30 can be used for a supporting tray. In this case, the guide protrusions 39*c* serve to support the supporting tray.

Figure 22:
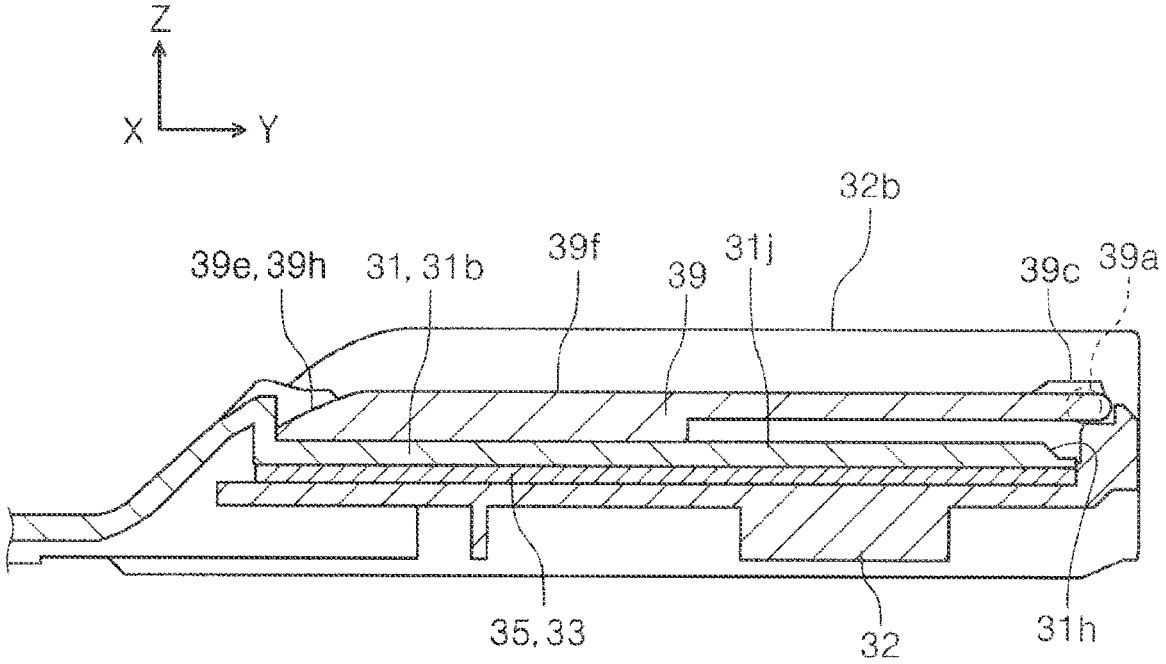
FIG. 22 is a cross section of the medium receiving tray that is in the stored state or the first unfolded state and is cut along the Y-Z plane at a position X1 in FIG. 17.

When the medium receiving tray 30 is in the stored state or in the first unfolded state, the movable support 39 is positioned above the first tray 31 as illustrated in FIGS. 17 and 22. In this state, the first support surface 31*q* of the first tray 31 and the second support surface 39*f* of the second tray 32 are positioned parallel to each other and form horizontal surfaces.

Figure 24:
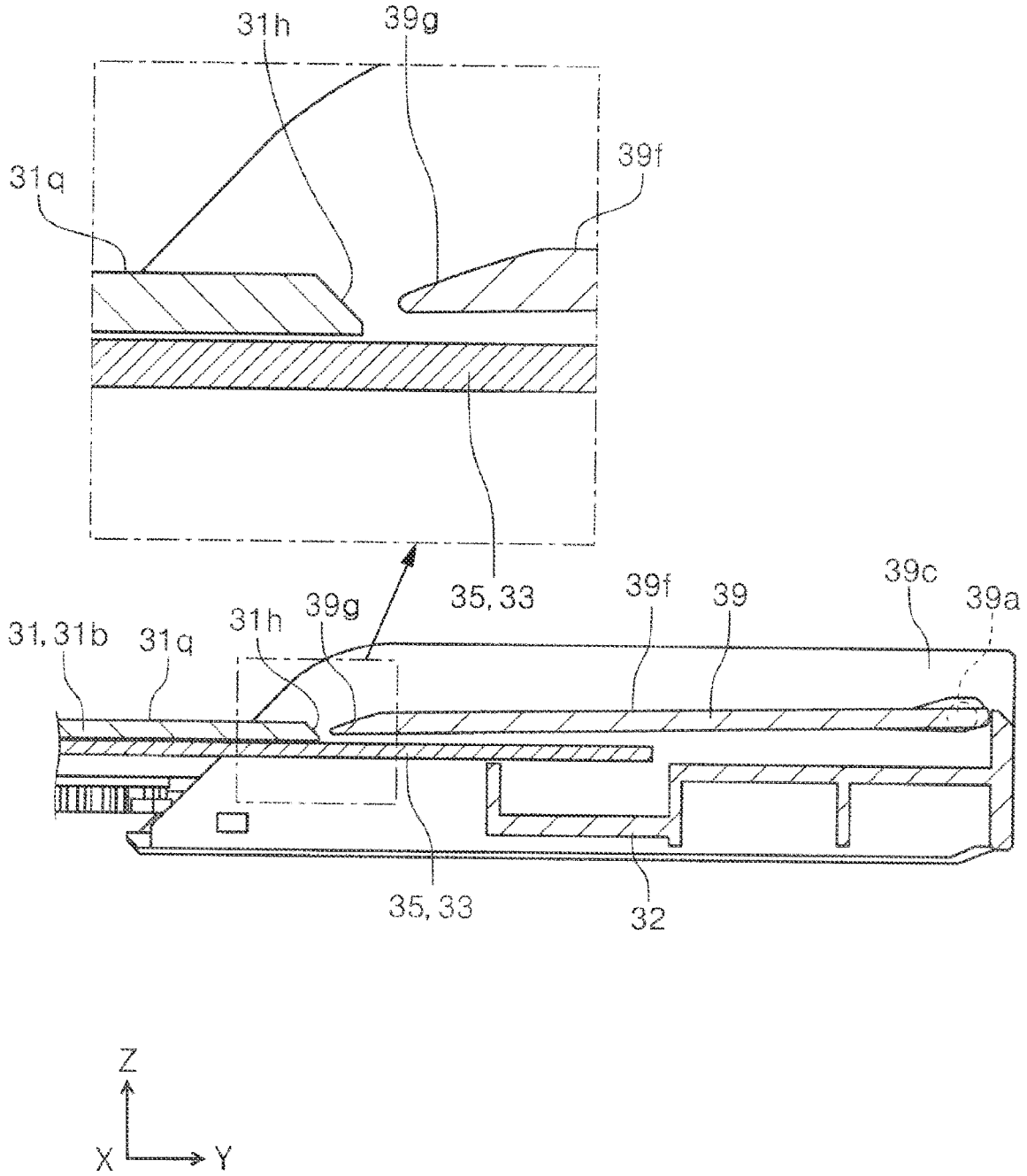
FIG. 24 is a cross section of the medium receiving tray that is in the second unfolded state and is cut along the Y-Z plane at a position X2 in FIG. 17.

When the medium receiving tray 30 is switched to the second unfolded state from this state, the free end 39*g* of the movable support 39 is detached from an end portion 31*h* of the first support surface 31*q*, which is positioned in the +Y direction, and is displaced downward as illustrated in FIG. 24. In other words, the movable support 39 slightly rotates counterclockwise in FIG. 24. The second support surface 39*f* of the movable support 39 is thereby inclined upward in the +Y direction, in other words, inclined upward toward the downstream in the medium discharging direction. The medium proceeds over the medium receiving tray 30 with the leading end thereof being oriented upward, which reduces the likelihood of the medium falling off the medium receiving tray 30. The rotation or positional change of the movable support 39 accompanies the state switching of the medium receiving tray 30 irrespective of whether a user forgets to do so. Moreover, the positional change of the movable support 39 can be implemented with a simple structure.

The free end 39*g* of the movable support 39 has a guide rib 39*e*. As illustrated in FIGS. 19 and 22, the guide rib 39*e* protrudes in the −Y direction, in other words, toward the upstream in the medium discharging direction. An inclined surface 39*h* is formed as the upper surface of the guide rib 39*e* so as to incline upward toward the downstream in the medium discharging direction.

Figure 23:
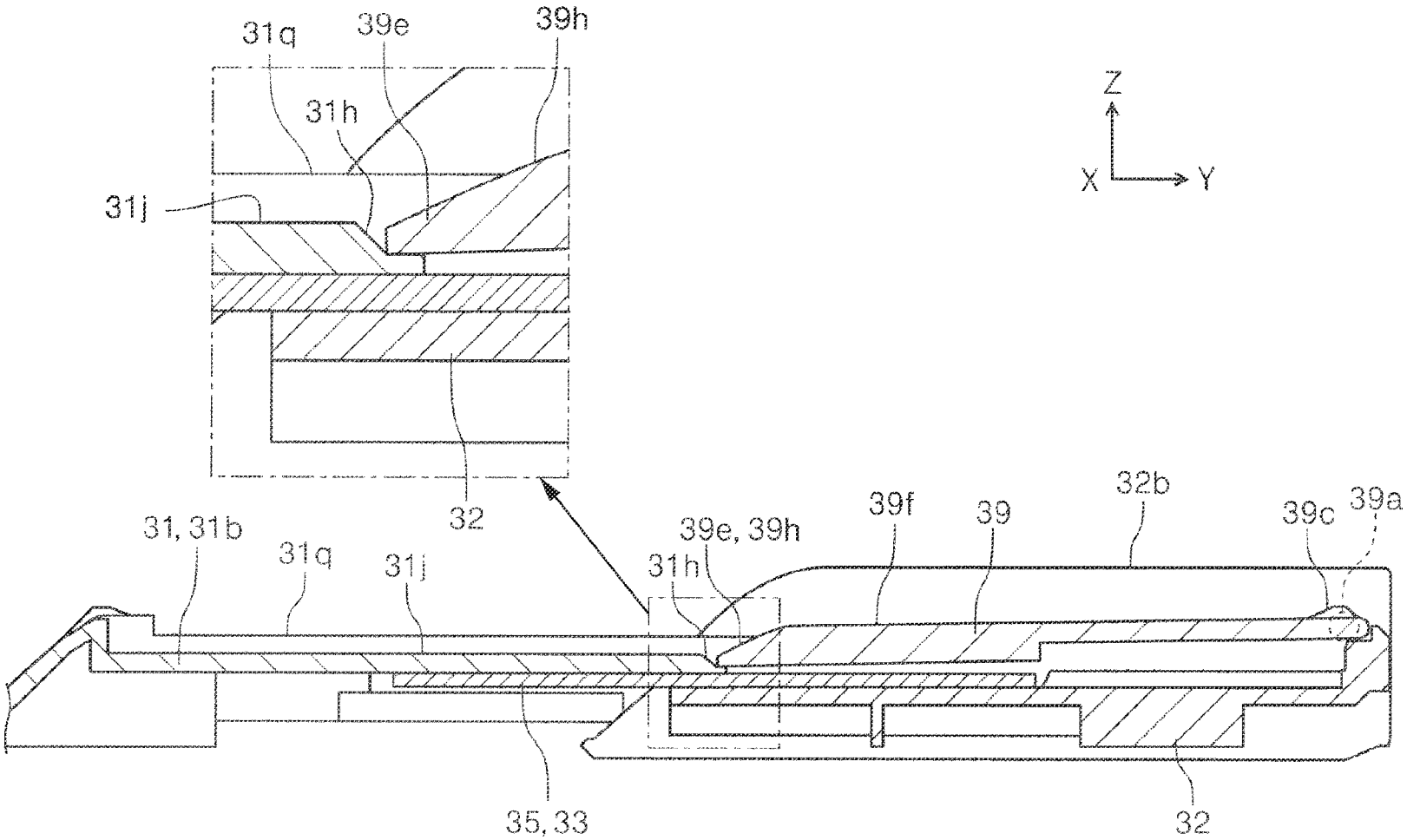
FIG. 23 is a cross section of the medium receiving tray that is in the second unfolded state and is cut along the Y-Z plane at the position X1 in FIG. 17.

In addition, as illustrated in FIG. 23, a guide surface 31*h* is formed at the downstream end of the first support surface 31*q* of the first tray 31. The guide surface 31*h* guides the guide rib 39*e* (i.e., free end 39*g*) of the movable support 39 onto the first support surface 31*q* when the medium receiving tray 30 is switched from the second unfolded state to the first unfolded state or the stored state. The guide surface 31*h* thereby prevents the free end 39*g* from getting caught by the first tray 31 when the medium receiving tray 30 is switched from the second unfolded state to the first unfolded state or the stored state.

Figure 27:
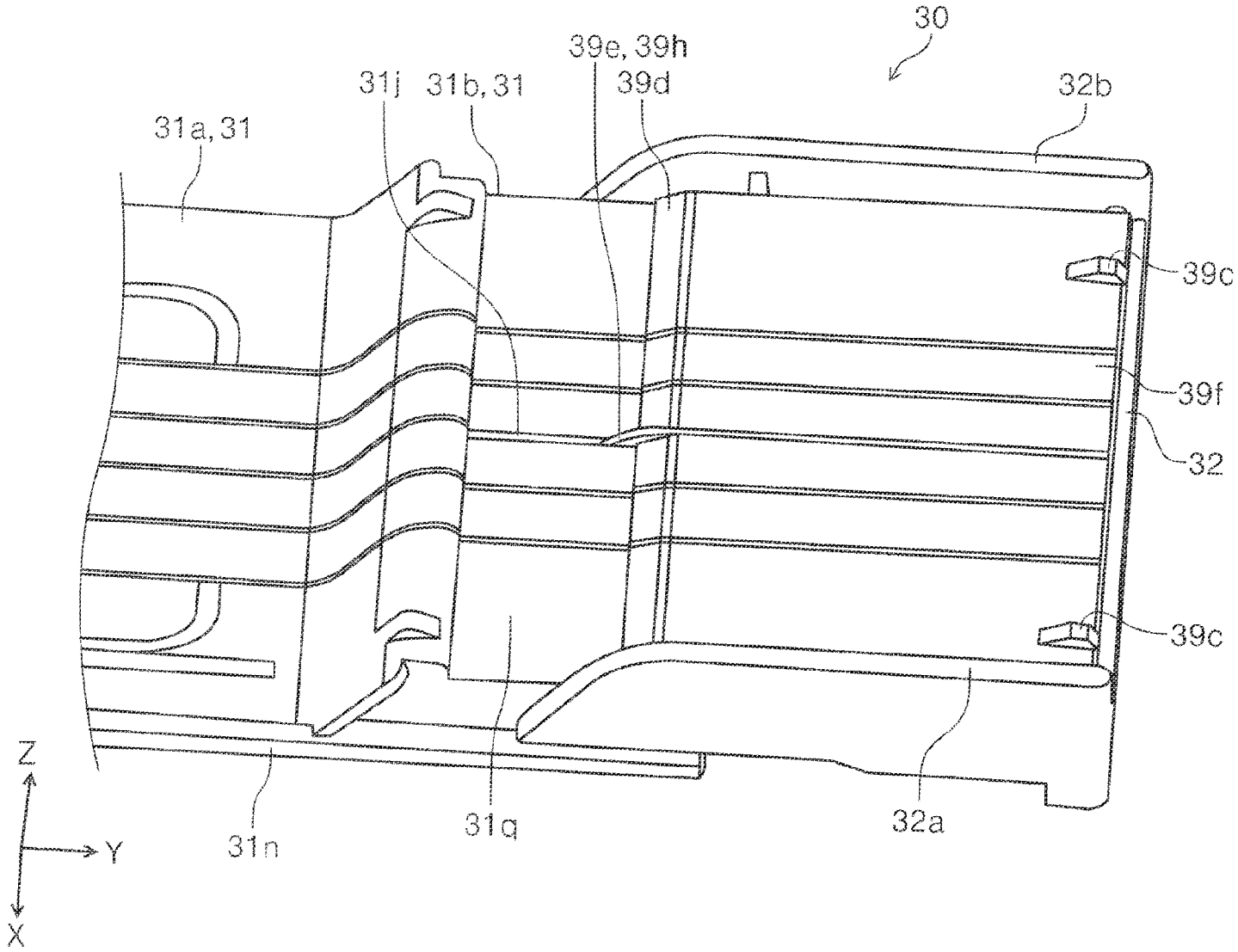
FIG. 27 is a perspective view illustrating the medium receiving tray that is in a transition state from the stored state or the first unfolded state to the second unfolded state.

In addition, as illustrated in FIGS. 22, 23, 26, and 27, a groove 31*j* is formed in the first tray 31 so as to extend in the Y-axis direction or in the medium discharging direction. The groove 31*j* is provided to receive the guide rib 39*e* of the movable support 39. When the medium receiving tray 30 is in the transition state between the second unfolded state and the first unfolded state or the stored state as illustrated in FIG. 27, the inclined surface 39*h*, formed as the upper surface of the guide rib 39*e*, is positioned so as to extend from a position below the first support surface 31*q* to a position above the first support surface 31*q*.

In other words, when the medium receiving tray 30 is in the transition state between the second unfolded state and the first unfolded state or the stored state, a recording medium tends to be caught by the free end 39*g* because the free end 39*g* of the movable support 39 is positioned above the first support surface 31*q*. Providing the guide rib 39*e*, however, reduces the likelihood of the recording sheet getting caught by the free end 39*g*.

Note that the present disclosure is not limited to the embodiments described above and various modifications can be made within the scope of the disclosure set forth in the claims, and accordingly, such modifications are to be included in the disclosure.

What is claimed is:

1. A recording apparatus, comprising:

an apparatus body including a recording device to perform recording onto a medium; and a medium receiving tray configured to be switched between a first state in which the medium receiving tray is stored in the apparatus body and a second state in which the medium receiving tray is protruded furthest from the apparatus body and also configured to receive the medium discharged from the apparatus body in the second state or in a state in which the medium receiving tray is protruded from the first state to the second state, wherein the medium receiving tray includes a first tray and a second tray, the first tray being displaceable relative to the apparatus body, the second tray being displaceable relative to the first tray, the second tray being protruded further than the first tray from the apparatus body when the medium receiving tray is in the second state, the first tray has a first support surface that supports the medium when the medium receiving tray is in the second state, the second tray has a movable support that is rotatable with an upstream end thereof serving as a free end of the movable support, the movable support is on an upper part of the second tray, an upper surface of the movable support corresponds to a second support surface for supporting the medium directly in the second state, the movable support is positioned above the first support surface when the medium receiving tray is in the first state, and when the medium receiving tray is switched from the first state to the second state, the free end of the movable support is detached from a downstream end of the first support surface and displaced downward, and the second support surface is thereby inclined upward toward a downstream in a medium discharging direction.

2. The recording apparatus according to claim 1, wherein a guide surface is formed at the downstream end of the first support surface in the medium discharging direction so as to guide the free end of the movable support onto the first support surface when the medium receiving tray returns from the second state to the first state.

3. The recording apparatus according to claim 1, wherein the movable support has a guide rib formed at the free end so as to protrude upstream in the medium discharging direction, and the guide rib has an inclined surface that is inclined upward toward the downstream in the medium discharging direction, a groove is formed in the first tray so as to extend in the medium discharging direction and so as to engage the guide rib, and when the medium receiving tray is in a transition state between the first state and the second state, the inclined surface of the guide rib is positioned so as to extend from a position below the first support surface to a position above the first support surface.

4. The recording apparatus according to claim 1, further comprising:

a motor that provides power for switching the state of the medium receiving tray;

a pinion gear that engages a first rack that is formed in the first tray so as to extend in a displacement direction of the second tray and also engages a second rack that is formed in the second tray so as to extend in the displacement direction; and a displacing unit that rotatably supports the pinion gear and is displaced in the displacement direction by the power of the motor.

5. The recording apparatus according to claim 4, further comprising:

a third rack that is formed in the displacing unit so as to extend in the displacement direction of the first tray and the second tray;

a second pinion gear that engages the third rack; and a clutch that is disposed in a power transmission path from the motor to the second pinion gear and that transmits the power of the motor using friction, wherein both of the first tray and the second tray are displaced by rotation of the second pinion gear.

6. The recording apparatus according to claim 5, further comprising:

a frame that displaceably supports the first tray, wherein when the state of the medium receiving tray is switched, friction generated between the displacing unit and the first tray is greater than friction generated between the first tray and the frame.

7. The recording apparatus according to claim 6, further comprising:

a friction member that generates friction between the displacing unit and the first tray; and a pressing member that presses the friction member against the first tray.

8. The recording apparatus according to claim 1, wherein the movable support has a shape of a tray, the first support surface is parallel to the second support surface in the first state, and each of the first support surface and the second support surface is a horizontal surface in the first state.

* * * * *